US005302788A

United States Patent [19]

Link et al.

[11] Patent Number: 5,302,788

[45] Date of Patent: Apr. 12, 1994

[54] MOLDED CASE CIRCUIT BREAKER HAVING TRAPEZOIDALLY SHAPED SHAFT

[75] Inventors: Donald A. Link, Hubertus; Michael R. Larsen, Milwaukee; Edward L. Wellner, Colgate, all of Wis.

[73] Assignee: Eaton Corporation, Cleveland, Ohio

[21] Appl. No.: 98,992

[22] Filed: Jul. 29, 1993

Related U.S. Application Data

[62] Division of Ser. No. 926,484, Aug. 6, 1992.

[51] Int. Cl.[5] ..... H01H 23/00

[52] U.S. Cl. ..... 200/401; 200/244; 200/50 C; 335/8

[58] Field of Search ..... 200/401, 400, 288, 244, 200/50 C; 335/8, 9, 10

[56] References Cited

U.S. PATENT DOCUMENTS

| | | | |
|---|---|---|---|
| 3,003,046 | 10/1961 | De Torre | 200/401 |
| 3,134,878 | 5/1964 | Jencks | 200/244 |
| 4,278,958 | 7/1981 | Kandatsu | 335/10 X |
| 4,480,242 | 10/1984 | Castonguay et al. | 200/244 X |
| 4,484,164 | 11/1984 | McClellan et al. | 200/244 X |
| 4,891,617 | 1/1990 | Beatty et al. | 335/8 X |
| 5,057,806 | 10/1991 | McKee et al. | 335/9 |

*Primary Examiner*—Glenn T. Barrett
*Attorney, Agent, or Firm*—L. G. Vande Zande

[57] ABSTRACT

Molded case circuit breaker having collapsible toggle linkage with rectangular cross section knee pin non-rotatably held within open rectangular slots in upper link, bifurcated movable contact fingers loosely guided for pivotal movement about fixed pin to break contact welds, helical compression springs biasing bifurcations against faces of a stationary connector, trapezoidal cross section shaft biasing shaft against a fixed corner of clamping strap and frame, increasing clamping force and increasing tool clearance, operating handle which changes pivot point moving to RESET position, reducing lateral force component of operating springs for reliable return of handle to OFF position, dual stops for movable contact fingers to spread impact forces along fingers, greater contact separation in poles not containing operating mechanism, slot motor laminations providing metal reinforcement to separate arc chamber housing which is cooperatively interlocked with base to distribute structural strength, terminal cover with arc vent extension angled downwardly, extended lug cover with second arc vent extension interlocked to terminal cover and arc chamber housing for no-fastener securement, trip unit armature pivoted in crested surface of molded pocket and connected to trip bar by wire bail for space-efficient location of parts, and accessory devices supported on and secured to trip unit housing have throw-away pin locking.

6 Claims, 16 Drawing Sheets

OFF
19
19
2

MOLDED CASE CIRCUIT BREAKER HAVING TRAPEZOIDALLY SHAPED SHAFT

CROSS-REFERENCE TO RELATED APPLICATIONS

This application is a division of D.A. Link et al copending application Ser. No. 07/926,484 filed Aug. 6, 1992, entitled Molded Case Circuit Breaker. This application is also related to copending application of D.A. Link et al copending application Ser. No. 08/098,997 filed Jul. 29, 1993 entitled Molded Case Circuit Breaker Having Rectangular Knee Pin Non-Rotatably Keyed to Toggle Linkage, and D.A. Link et al copending application Ser. No. 08/098,995 filed Jul. 29, 1993 entitled Molded Case Circuit Breaker Having Changing Pivot Location for the Operating Handle, each filed concurrently herewith.

BACKGROUND OF THE INVENTION

This invention relates to molded case circuit breakers operable in response to fault currents to open the contacts and interrupt a circuit in which the circuit breaker is connected. While not limited thereto this invention relates to circuit breakers of the aforementioned type which are operable upon high fault currents to limit the peak let-through current. The circuit breaker of this invention is intended to handle moderately high fault current levels which upon interruption can cause explosive forces and expel hot ionized arc gasses. Circuit breakers of this type are known and have generally been useful for their intended purposes. However, this invention relates to improvements thereover.

SUMMARY OF THE INVENTION

This invention provides a molded case circuit breaker having a pivoted movable contact finger which is conductive through a wiping contact at the pivot location and utilizes helical compression springs for providing contact force for the wiping contact. An operating mechanism connects a collapsible toggle linkage to the movable contact finger of a center pole of the circuit breaker. Movable contact fingers in outer poles of the circuit breaker are connected for unitary movement with the center pole contact finger by a common shaft extending across the poles of the circuit breaker having a frame member for each movable contact finger clamped thereon. The ordinarily rectangular shaft is beveled to a near trapezoid shape in this invention to increase tool access to a terminal screw in the lower portion of the circuit breaker. However, the beveled surface of the shaft also provides improved clamping for securing the frames tightly to the shaft and improved uniformity in positioning of the respective frames to the shaft. The movable contact fingers are resiliently connected to the respective frames by a pair of spring loaded rollers working on cam surfaces of the frame. The springs are connected to anchor points located below the pivot of the movable contact finger to ensure that a downward contact closing bias is always exerted on the contact finger.

The operating mechanism employs a well known two-link collapsible toggle linkage. A knee pin interconnecting the links is made non-rotatable with one of the links by a simple rectangular cross-sectional shape which also provides increased shoulder surface areas at opposite ends of the rectangular section from which cylindrical pins extend for mounting the other of the toggle links. The members which make up the other link are guided by the shoulder surface for increasing stability of the linkage with respect to twisting. The rectangular shaped knee pin is readily manufactured and easily assembled.

Dual stops are provided for each movable contact finger, thereby spreading impact forces along the finger for preventing bending of the contact finger about a single stop. The stop position of the center pole movable contact finger is limited by space available in view of the operating mechanism, and the operating mechanism actually provides one of the stops in the center pole. The movable contact fingers in the outer two poles, which do not contain the operating mechanism, are stopped at a greater distance from the stationary contact than in the center pole to thereby increase the contact separation gap and arc distance for enhanced performance of the circuit breaker.

The operating handle is pivotally mounted for movement between OFF and ON positions including movement to an intermediate TRIPPED position. Movement of the handle beyond the OFF position to a RESET position causes the handle to change pivot points to reduce a component of spring force that would tend to hold the handle in the RESET position instead of permitting the handle to return to the OFF position once resetting is accomplished. A latching mechanism includes a latch held in a detented RESET position upon tripping. A trip unit mechanism takes advantage of parts placement by utilizing a bail around an upper end of a rockable armature to exert a pulling moment on a rotatable trip bar at a greater distance from the pivot of the armature. Engagement of the trip bar by a trip lever of the latching mechanism is controlled by a particular shape of the trip lever for repeatedly achieving identical latching engagement of the two members.

A separate housing member overlies the contacts area to define an arc chamber. This housing member has pockets for receiving magnetic steel flux concentrators for current limit operation of the breaker. The steel flux concentrators reinforce the structural strength of the molded housing, and the separate housing overlaps the molded base to provide additional strength for the base. An extended lug cover is attached to the breaker housing by first interlocking with a terminal cover and then interlocking with the arc chamber housing when the assembled covers are attached to the breaker housing. The terminal cover and extended lug cover provide an arc vent passageway angled downwardly for improved performance.

Accessory devices are attached to the sub-housing of a trip unit with a sliding fit and retained by a snap catch. An alarm switch is mounted directly over the latch, snapping in place by the snap catch. A removable pin is inserted through an accessory device housing to hold an actuator for the device inactive and in proper position during installation.

The invention and its advantages will become more apparent in the following description of the preferred embodiment when read in conjunction with the accompanying drawings.

BRIEF DESCRIPTION OF THE DRAWINGS

FIG. 17 is an exploded isometric view of the several masks shown in FIGS. 15 and 16;

FIG. 18 is an exploded side elevational view of the circuit breaker of this invention showing a molded insulating base with the circuit breaker mechanism mounted therein, an arc chamber housing separated from the base, a cover separated from the base, a terminal cover separated from the arc chamber housing and an extended lug cover separated from the arc chamber housing and the terminal cover;

FIG. 20 is a partial sectional view of one end of the circuit breaker housing wherein an extended lug cover has been added, the section showing a vent opening within the terminal cover and the extended lug cover;

DETAILED DESCRIPTION OF THE PREFERRED EMBODIMENT

Figure 1:
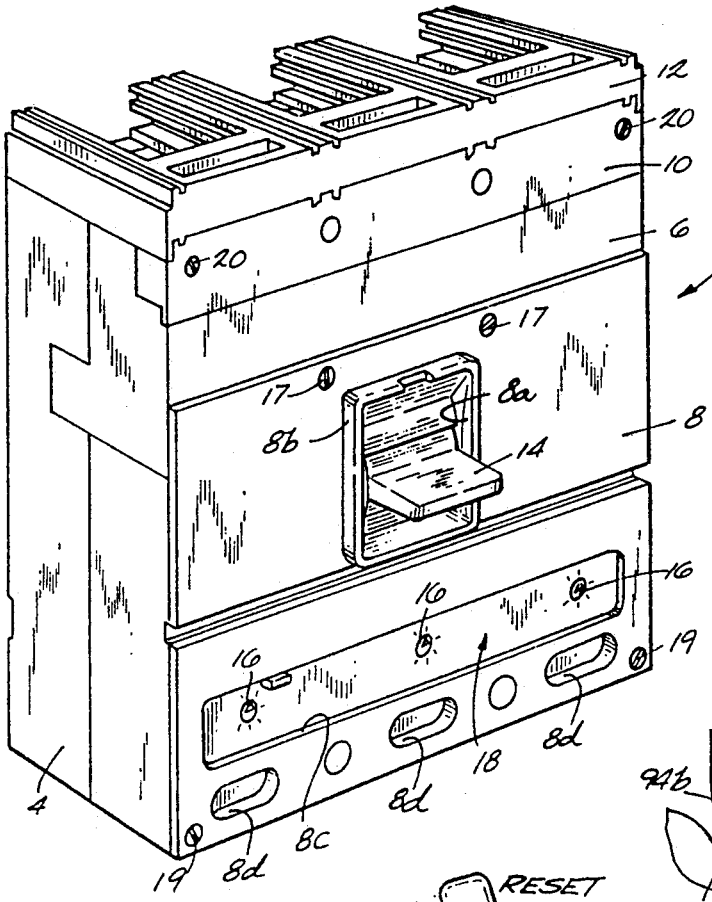
FIG. 1 is a perspective view of a molded case circuit breaker constructed in accordance with this invention.

The molded case circuit breaker 2 constructed in accordance with this invention is shown in perspective view in FIG. 1. The molded case circuit breaker comprises a multi-part molded insulating housing comprising a base 4, an arc chamber housing 6, a cover 8, a terminal cover 10 and an extended lug cover 12. The cover 8 is provided with two openings, a centrally located opening 8*a* having a bezel 8*b* therearound for an insulating operating handle cap 14 and a lower elongated opening 8*c* providing access to magnetic trip adjustment knobs 16 of a trip unit 18. Three additional elongated openings 8*d* are located along the lower edge of the cover 8 as viewed in FIG. 1, the openings 8*d* providing access to wiring lugs (not shown) which are attached to terminals of the breaker. Cover 8 is secured to base 4 and arc chamber housing 6 by pairs of screws 17 and 19. The terminal cover 10 and extended lug cover 12 are retained in place by an interlocking structural relationship with the base 4 and the arc chamber housing 6 and with each other as well as by a pair of screws 20 extending through the terminal cover 10 into the arc chamber housing 6. The cooperating interlocking structure will be described in greater detail hereinafter.

Figure 2:
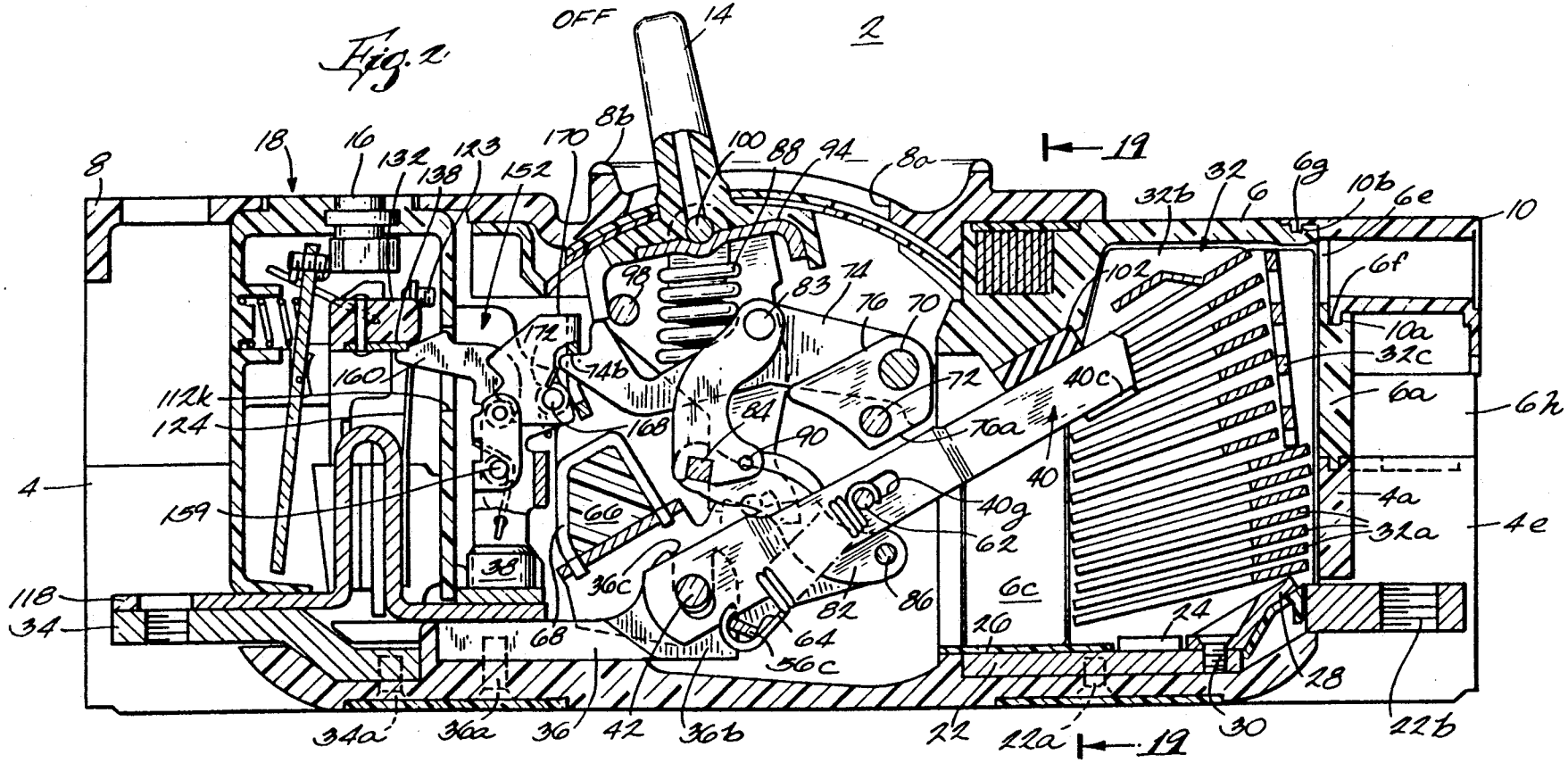
FIG. 2 is a cross sectional view through a pole of the circuit breaker of FIG. 1 which contains the operating mechanism for the circuit breaker, showing the circuit breaker in an OFF position.

The molded case circuit breaker 2 shown in FIG. 1 is a three pole device. FIG. 2 is a cross sectional view taken through the center pole of the circuit breaker of FIG. 1. In a manner that is well known in the art of molded case circuit breakers, the construction of each of the three poles is substantially identical, except that the center pole contains the operating mechanism. The contracts of the outer two poles are joined to the operated center pole by a common shaft. Accordingly, the following description will be with respect to the center pole and the outer two poles will not be particularly described except for occasional specific reference.

The molded insulating base 4 is a shallow box-like structure having upstanding side walls and partial barriers to define three compartments. A terminal 22 is mounted on the floor of the base at the right-hand end as viewed in FIG. 2 by screws 22*a* and extends through an opening in an end wall 4*a* of the base. A stationary contact element 24 is attached to the terminal 22 within the base and a hole 22*b* is provided in the portion of the terminal extending beyond the end wall 4*a* of the base for attaching a wiring lug (not shown) to the terminal. Terminal 22 has a molded insulator 26 disposed thereover within the base and has an arc runner 28 attached thereto by a screw 30. The end of the circuit breaker containing the stationary contact 24 is referred to as the ON end. An arc chute assembly 32 is disposed in the base over the terminal 22 and stationary contact 24. The arc chute assembly 32 comprises a plurality of splitter plates 32*a* retained in a well known tab-in-slot method of assembly between a pair of fiberboard insulator plates 32*b*. A perforated fiberboard insulator plate 32*c* is also retained between the two insulator plates 32*b* in a tab-in-slot construction at the top of the arc chute assembly to break up the arc gasses as they are emitted from the circuit breaker.

A terminal 34 is mounted on the floor of the base 4 at the left-hand end as viewed in FIG. 2 by screws 34*a*, a portion of the terminal 34 extending to the exterior of the breaker. This left-hand end of the circuit breaker housing is called the OFF end of the circuit breaker. A connector plate 36 is also attached to the floor of the base by screws 36*a*. Connector plate 36 and terminal 34 are aligned along a major dimension of each of these members and of the respective compartment within the circuit breaker housing. The right-hand end of the connector 36 as viewed in FIG. 2 has an upstanding projection 36*b* having an upwardly open slot 36*c* therein. Trip unit 18, which will be described in detail later, has a bus strap 118 which is positioned on the terminal 34 and connector 36 and is securely attached to the connector 36 by a hexagonal socket cap screw 38 or the like. A screw attaching a wiring lug (not shown) to the externally projecting end of terminal 34 will function to clamp the trip unit bus strap to terminal 34 in good electrical conducting relation.

Figure 7:
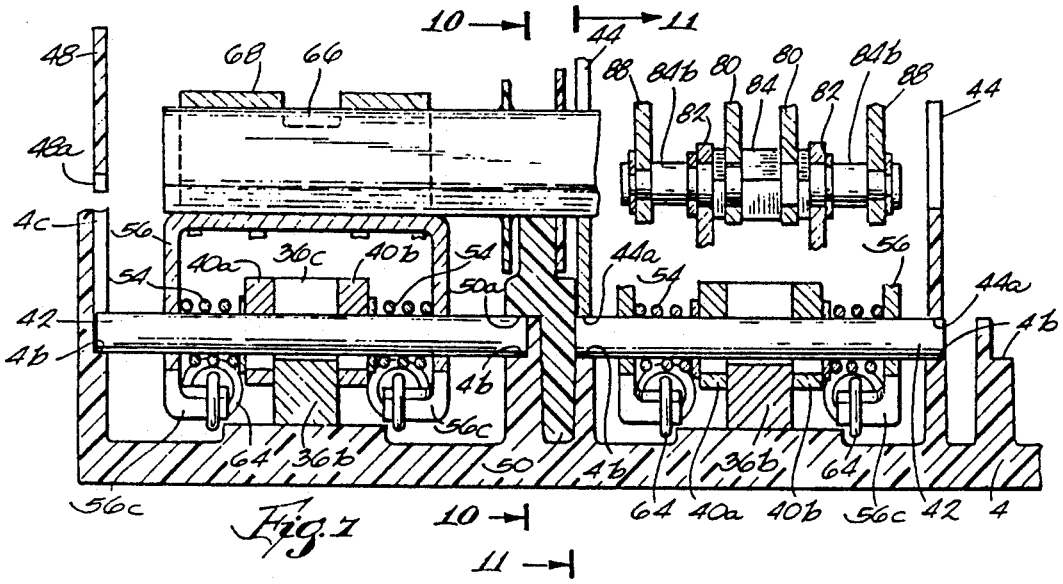
FIG. 7 is a fragmentary cross sectional view taken along the line 7—7 in FIG. 3 showing a conductive pivot of the circuit breaker.
Figure 11:
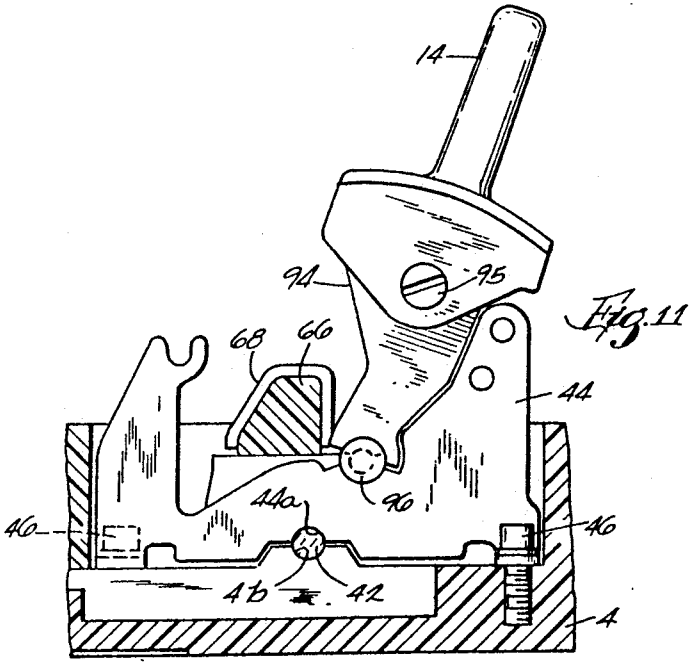
FIG. 11 is a fragmentary cross sectional view showing a mounting bracket for the operating mechanism trapping an axle pin for the conductive pivot against a seat in a molded base of the circuit breaker of this invention.

A movable contact finger 40 is loosely guided for pivotal movement about an axle pin 42 which extends through the slot 36*c* of connector projection 36*b*. Referring also to FIGS. 7, 10 and 11, the base 4 is provided with upwardly open semi-cylindrical recesses 4*b* in upstanding walls at opposite sides of the respective compartments. The opposite ends of a respective axle pin 42 are positioned in the semi-cylindrical recesses 4*b*. In the center pole, brackets 44 for supporting the operating mechanism have downwardly open semi-cylindrical recesses 44*a* in their bottom edge. The brackets 44 are installed to the base 4 by appropriate screws 46 (FIG. 9) passing through holes (not shown) in mounting tabs of the brackets. The semi-cylindrical recess 44*a* overlies the respective end of axle pin 42 to secure the pin within the housing. As seen in FIG. 11, a small space is provided between the upward projection in the base containing the semi-cylindrical recess 4*b* and the bottom edge of the respective bracket 44 whereby the ends of the axle pin 42 are firmly clamped by the brackets. In the outer poles, the outermost upwardly opening semi-cylindrical recess 4*b* is formed in a side wall of the base 4. A dovetail groove 4*c* (FIG. 9) is molded in the side wall open to the upper edge of the base, to receive a complementally formed retainer 48 having a downwardly open semi-cylindrical recess 48*a* (FIG. 7) for overlying the respective end of the axle pin 42 when positioned in the groove 4*c*. The retainer 48 is dimensionally toleranced to provide a small clearance between its lower edge and the bottom of the groove 4*c* when initially positioned in the groove upon the axle pin 42 and to project slightly above the upper edge of the base to be engaged by cover 8 when the latter is installed, thereby forcing the retainer 48 tightly down upon the respective end of the axle pin 42 to firmly retain the pin in place. Molded insulating phase barriers 50 as best seen in FIG. 10 are attached to the floor of the base by screws 52 (FIG. 9) passing through holes in feet molded on the phase barrier 50 to secure the other end of the axle pin 42 in the outer poles. The bottom edge of phase barrier 50 is provided with a downwardly open semi-cylindrical recess 50*a* which overlies the axle pin and cooperates with the upwardly open cylindrical recess 4*b* to clamp the pin 42 firmly in place in the respective outer pole.

Figure 8:
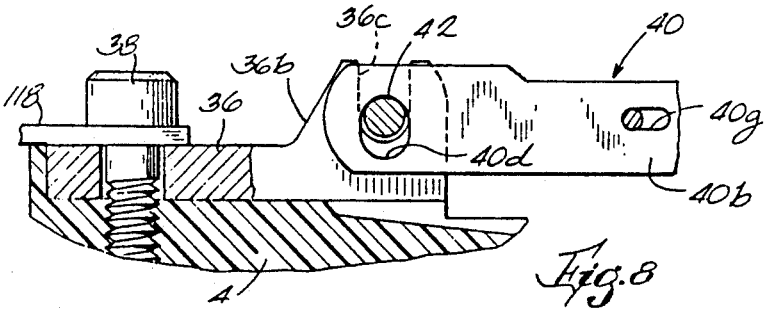
FIG. 8 is a fragmentary cross sectional view taken along the line 8—8 in FIG. 9 showing the conductive pivot for the movable contact finger.
Figure 9:
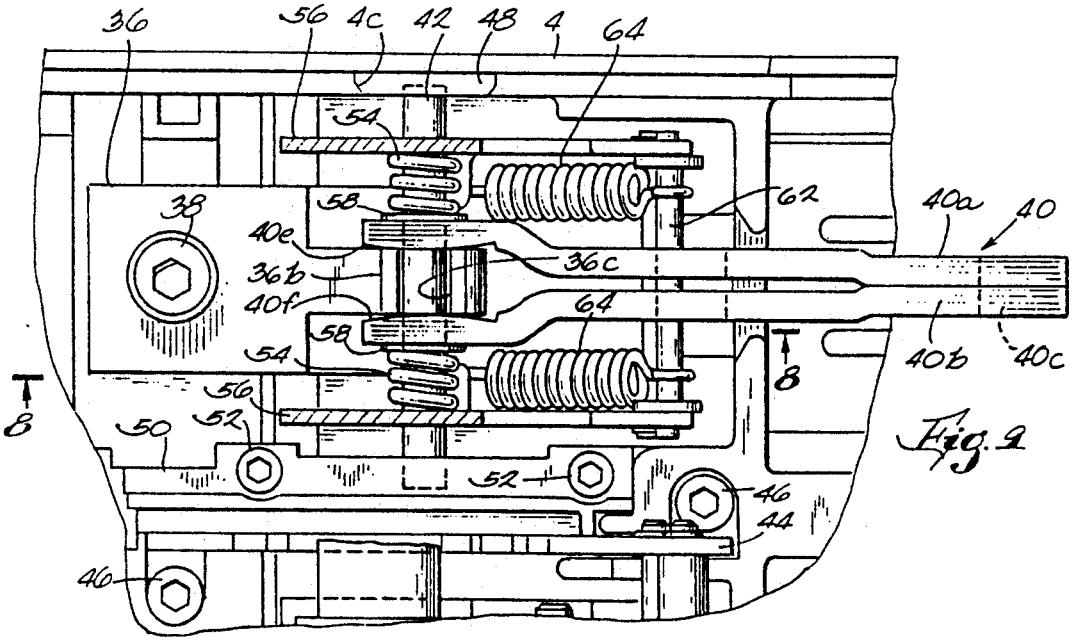
FIG. 9 is a fragmentary cross sectional view taken along the line 9—9 in FIG. 3 showing a top view of the movable contact finger and conducting pivot.
Figure 10:
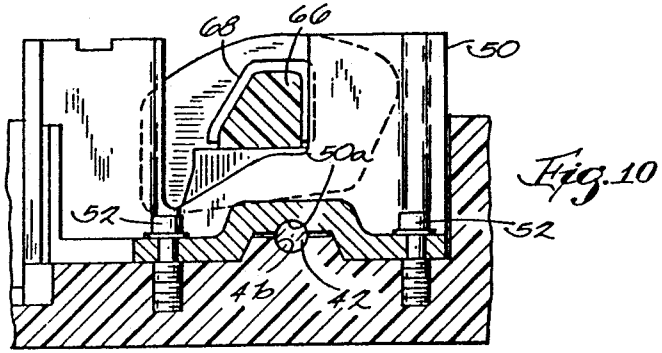
FIG. 10 is a fragmentary cross sectional view showing a phase barrier trapping an axle pin for the conductive pivot against a seat in a molded base of the circuit breaker of this invention.

As seen in FIGS. 8 and 9, the slot 36*c* in the connector 36 provides clearance for axle pin 42 which extends therethrough. Movable contact finger 40 comprises a pair of coextensive conductive members 40*a* and 40*b* joined together at the right-hand end by welding or the like. A movable contact element 40*c* is attached to the bottom of the right-hand end of the finger 40 for cooperative engagement with stationary contact element 24. The opposite end of the movable contact finger members 40*a* and 40*b* are spread apart to create a bifurcated configuration. The separate tines of the bifurcated end of the movable contact finger 40 are provided with slots 40*d* elongated perpendicularly to the major dimension of the movable contact finger. The axle pin 42 extends through the slots 40*d* to provide a loose pivot for the movable contact finger 40. Interior surfaces 40*e* and 40*f* (FIG. 9) of the bifurcated ends of movable contact finger members 40*a* and 40*b* have an arcuate crest which is in face-to-face contact with a respective opposite surface of the upstanding projection 36*b* of connector 36. The spacing between the bifurcated ends of the movable contact finger members 40*a* and 40*b* is preferably slightly less than the thickness of projection 36*b* to provide initial contact pressure between the contact finger and the connector. Additional contact pressure is provided by a pair of helical compression springs 54 disposed over the axle pin 42 to bear against the outer surfaces of the bifurcated ends of movable contact finger members 40*a* and 40*b*. Springs 54 are compressed between the contact finger and a rigid frame 56 which is pivotally mounted on the axle pin 42 as will be described hereinafter. The use of helical compression springs in this application is greatly preferred over Belville washers or other axially directed thrust elements because the force provided by the helical spring can be more readily and predictably controlled. As seen in FIG. 9, washers 58 are disposed between the outer surface of the respective movable contact finger member and the spring 54.

Figure 3:
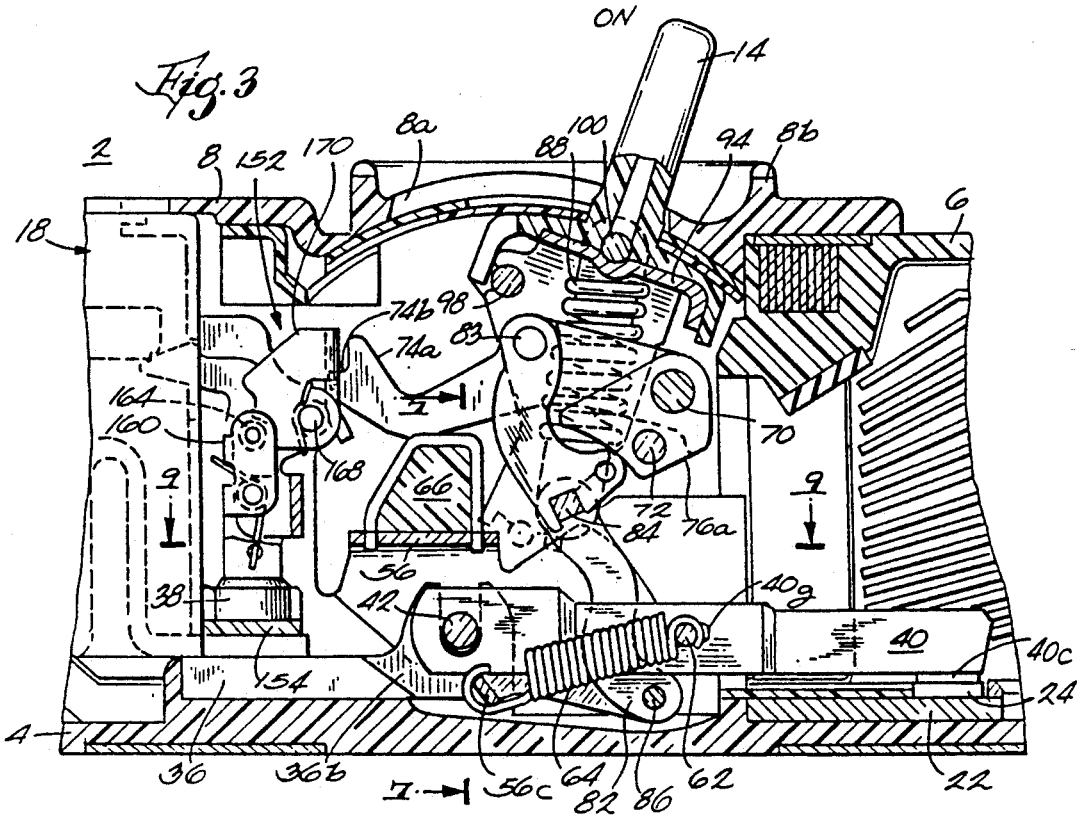
FIG. 3 is a fragmentary cross sectional view similar to FIG. 2 showing the circuit breaker in an ON position.

Frame 56 provides a means of connecting the movable contact finger 40 to an operating mechanism and for connecting the movable contact fingers of each pole of the circuit breaker together to operate substantially in unison. Frame 56 is an inverted U-shaped member having clearance holes in the legs for receiving axle pin 42, the frame pivoting on the axle pin. The legs of frame 56 extend downwardly and to the right as viewed in FIG. 31. The right-hand edge of the respective legs of the frame is provided with a cam surface 56*a* and a recess 56*b*. A pair of cam follower rollers 60 are rotatably mounted on opposite ends of a pin 62 which extends transversely through a slot 40*g* in movable contact finger 40. Rollers 60 are held in engagement with the respective cam surface 56*a* of the frame by helical tension springs 64 disposed on either side of the contact finger 40 and connected to the pin 62 at one end and to an anchor tab 56*c* on the frame 56 at the other end. The slot 40*g* in the contact finger is elongated in the direction of the major dimension of the contact finger whereby the pin 62 can translate within the slot. Springs 64 tend to keep pin 62 at the left-hand end of slot 40*g* and rollers 60 positioned within the recess 56*b* to maintain the movable contact finger 40 substantially fixed for movement with the frame 56. As seen in FIG. 3, when the circuit breaker is in the ON position and the movable contact 40*c* engages the stationary contact 24, the movable contact finger 40 is deflected slightly upward relative to the frame 56 causing the roller 60 to move outwardly in the recess 56*b*, thereby providing a downward force on the movable contact finger 40 and contact pressure on the engaged contacts 40*c* and 24. When the operating mechanism is operated to the OFF or TRIPPED position, the springs 64 urge the rollers 60 back into the recess 56*b* to resiliently fix the movable contact finger for motion with the frame. However, circuit breaker 2 is a current limiting circuit breaker and as such, contact finger 40 is movable relative to the frame 56 independently of movement of the frame by the operating mechanism. In the event of a high fault current, movable contact finger 40 is magnetically driven away from the stationary contact 24 while the operating mechanism remains static. This movement causes the rollers 60 on pins 62 to move out of the recesses and upwardly along the cam surfaces 56*a* of the legs of U-shaped frame 56. The springs 64 provide a desired force to maintain the movable contact finger 40 in position relative to the frame 56, yet permit it to be driven from the detent recess 56*b* to operate in a current limit mode. It is also desirable that the movable contact finger 40 return to the normal position relative to the frame 56 and not be biased open along the cam surface 56*b* so as to cause possible single phasing of the circuit breaker and the system in which it is connected. Therefore, to achieve efficient utilization of the springs 64 to always provide a downward force on the pin 62 and rollers 60 engaging the cam surfaces 56*b*, the anchor point tabs 56*c* for the opposite ends of the springs 64 are located below and to the right of the pivot for the movable contact finger 40 as viewed in FIGS. 2–5.

The frames of all three poles of the circuit breaker are tied together for unitary operation by a shaft 66 which extends across all three poles. Shaft 66 is secured to the bight portion of the respective inverted U-shaped frames 56 by straps 68 which encompass the shaft 66 and are attached to the respective frame 56 by staking or other suitable attachment method. Shaft 66 is customarily rectangular, most often square, in cross section, to provide firm non-rotational attachment to the frame. This invention provides a shaft 66 which is substantially trapezoidal in cross section by beveling substantially the entire surface of one edge. The beveled edge is disposed substantially vertically when the operating mechanism is in the OFF or TRIPPED condition to increase tool access to screw 38 holding the trip unit 18 to the connector 36. The trapezoidal configuration also has been found to provide improved clamping force for the shaft 66 to the respective frames 56 and to improve the positioning of the shaft and frames. The strap 68 is formed with an angled leg complementary to the beveled edge of the shaft. As seen in FIG. 2, the distal end of the angled leg of the strap is formed parallel to the opposite leg of the strap so that the strap is pulled straight downward upon the shaft during the staking operation. The angled leg of strap 68 engages the beveled surface of shaft 66 before the strap tightly engages the upper surface of the shaft, that being the surface opposite that which is resting on the bight portion of the frame 56. The engagement of the angled leg and beveled surface produces a force on the shaft 66 which has a component directed toward the frame 56 and a second component directed toward the straight leg of the strap 68, thereby forcing shaft 66 tightly against the straight leg of the strap. Therefore, lateral displacement of shaft 66 relative to the frame 56 of any of the poles may be held to a very close tolerance governed by the location of holes in the respective frames for receiving the tabs of the strap 68 which are to be staked. This enhances performance of the circuit breaker by effecting uniform action of the movable contact fingers 40 in each of the poles.

Figure 14:
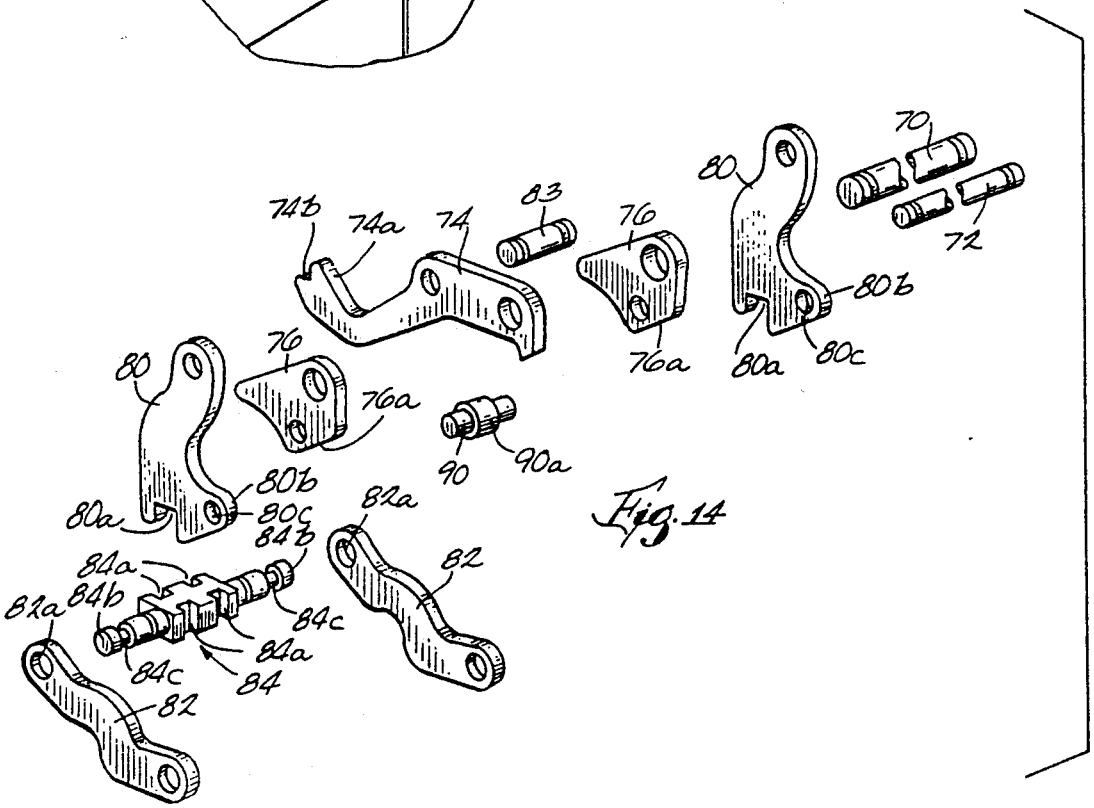
FIG. 14 is an exploded isometric view of a collapsible toggle linkage of the circuit breaker of this invention, particularly showing a rectangularly shaped knee pin.

The center pole of circuit breaker 2 contains the operating mechanism for the movable contact finger 40. Referring also to FIG. 14, pins 70 and 72 are attached to the right-hand upper end of the brackets 44 to extend transversely between the brackets. A latch lever 74 is pivotally mounted on pin 70. A pair of trip links 76 are retained on pin 70 adjacent opposite sides of the latch lever 74. The latch lever and trip links are maintained transversely positioned on the pin 70 by suitable retaining clips which engage in slots in the pin 70. A two-link collapsible toggle linkage is provided, comprising an upper link 80 and a lower link 82 joined by a knee pin 84. Each of the links actually comprises a pair of identical link members each having the same reference numeral, the upper link members being pivotally connected to the latch lever 74 on pin 83 intermediate its pivot on pin 70 and its distal latching end. The surface of latch lever 74 provides a good anti-twist guide surface for the members of the upper link 80. The lower link members 82 are mounted at their lower end on a pin 86 which is fixed between the legs of the U-shaped frame 56 below the movable contact finger 40. The location of pin 86 is chosen to be in an optimum location for maximum effectiveness of the linkage and the operating handle. To maintain a lower link connection to the pin 86 at its optimum location, the lower link 82 is formed in a distorted, shallow S-shape to provide necessary clearances of the lower link members with the pin 62 located in the slot 40*g* of movable contact finger 40 and to provide clearance for the widened portion of the movable contact finger forming the bifurcated ends. The lower end of the upper link members 80 and the upper end of the lower link members 82 are connected to a common knee pin 84 (best shown in FIG. 14) for the toggle. It is preferred in circuit breakers of this type that the knee pin be non-rotatable with respect to one of the links and therefore it is often splined, welded or otherwise rigidly secured to that link. The center portion of the knee pin 84 of this invention is rectangular in cross section, having a major and a minor dimension. Grooves 84*a* are provided in opposite surfaces of a short side of the rectangular cross section at predetermined spaced intervals to define substantially square cross sections between aligned grooves. The lower ends of the upper toggle link members 80 are provided with square slots 80*a* which are open to the bottom of the link and receive the square cross section of the knee pin 84 therein. The knee pin is readily attached to the lower ends of the upper toggle link members 80 and is prevented from rotating by virtue of the square cross section received within the square slots 80*a*. Rectangular surfaces adjacent the square cross section between the grooves 84*a* of the knee pin 84 provide good anti-twist stability for the lower end of the upper toggle link. Knee pin 84 also comprises a cylindrical shaft portion 84*b* extending from opposite ends of the rectangular central section. The upper end of the lower toggle link members 82 are provided with round clearance holes 82*a* to receive the cylindrical shaft portions 84*b* of the knee pin. The lower link members 82 are held firmly against the wide transverse shoulder formed by the rectangular central section of the knee pin 84 at the juncture of the cylindrical shaft portion 84*b* by C-shaped retaining clips or the like (not shown), that transverse shoulder surface providing a good anti-twist guide surface for the lower toggle links 82. Operating springs 88 for the toggle linkage are connected within grooves 84*c* near the outer ends of the cylindrical shaft portions 84*b* of the knee pin and are retained against removal from the shaft by suitable C-shaped retaining clips (not shown). Upper toggle link members 80 have a toe-like projection 80*b* at their lower end which has a hole 80*c* for receiving respective ends of a shouldered pin 90 having a cylindrical shoulder 90*a* disposed between the upper toggle link members 80.

Figure 6:
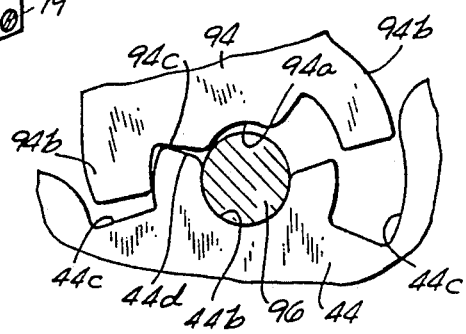
FIG. 6 is a fragmentary view showing a secondary pivot for an operating handle of the circuit breaker when moved beyond the OFF position to the RESET position.

An operating handle of the operating mechanism is a two piece assembly comprising an inverted U-shaped metal frame 94 (FIG. 11) having the aforementioned molded plastic handle cap 14 attached thereover by screws 95 (FIG. 11) which are turned into threaded openings in the legs of metal frame. The lower ends of the legs of the metal frame have an M-shaped configuration (FIG. 6). The center of the M has a shallow radius 94*a*. The outer legs 94*b* have an arcuate shape concentric with the radius 94*a*. The handle pivotally rests upon a shouldered bearing 96 located on each bracket 44, the bearing having a reduced diameter central portion which sits within a semi-cylindrical recess 44*b* in the bracket. The radius portion 94*a* of the M-shaped lower ends of the legs of handle frame 94 rest on the central reduced diameter portion of the bearings 96 to form a pivot for the handle. The brackets 44 are provided with arcuately shaped clearance slots 44*c* on either side of the semi-cylindrical recess 44*b* for receiving the outer legs 94*b* of the M-shaped lower ends of the handle frame. Thus, the reduced diameter central portion of the bearing 96 serves as a pivot for the operating handle moving between the ON and OFF positions. The RESET position shown in FIG. 5 requires movement of the handle toward the OFF end of the circuit breaker beyond the OFF position. When the breaker is reset, the handle should automatically return to the OFF position shown in FIG. 2. Movement to the OFF position is accomplished by a cam surface 74*a* on latch lever 74 driving a transverse pin 98 mounted between the legs of the handle frame 94 to the right as seen in FIG. 2 under the bias of the operating springs 88. However, such camming action involves static friction and a leftward component of force of the operating springs 88 (FIG. 5), which tend to prevent the handle from reliably returning to the OFF position. Accordingly, movement of the operating handle counterclockwise or toward the left in FIG. 2 beyond the OFF position causes a surface 94*c* (FIG. 6) of the M-shaped lower end of the handle frame to abut an upper end 44*d* of the bracket 44 and to pivot on the bracket, thereby causing the radius portion 94*a* of the operating handle to rise off the bearing 96, making a new pivot for the operating handle. This new pivot is disposed to the left of the original pivot through bearing 96 and therefore reduces the leftward force component on the operating handle caused by operating springs 88 sufficiently to ensure that a rightward force component of the latch lever cam surface 74*a* on the pin 98 will drive the handle to the OFF position from the RESET position. The operating springs 88 are connected between the knee pin 84 and a pin 100 mounted in a transverse groove in the bight portion of the U-shaped frame 94 of the handle. The operating springs 88 exert an upward tension force on the knee pin, retaining it tightly within the rectangular slots 80*a*. This operating spring force is transmitted through the upper toggle link members 80 to latch lever 74, biasing the latch lever clockwise about pin 70 as viewed in FIG. 2. Thus the operating spring exerts an upwardly directed force on the distal end of the latch lever 74, driving cam surface 74*a* against the pin 98 to provide initial impetus to movement of the handle rightward from the RESET position. The distal end of the latch lever becomes latched in a latching system as will be described hereinafter, and the leftward force component of the operating spring switches to a rightward directed component as the handle completes movement to the OFF position. Once in the OFF position, the handle frame 94 is again pivoted on the reduced diameter center portion of the bearing 96 and may be moved to the ON position to move the line of force of the operating springs 88 across the center of the pivotal connection of the upper toggle link 80 to the latch lever 74, thereby causing the toggle linkage to extend and drive the frames 56 clockwise to their down position as shown in FIG. 3. The toggle linkage may be manually controlled between extended and collapsed conditions by moving the handle between ON and OFF positions to move the line of action of the operating springs 88 across the pin 83 connection of the upper toggle link members 80 with the trip lever 74 in a well known manner. As is also well known in molded case circuit breaker operation, release of the trip lever 74 by the latching mechanism will cause the operating springs 88 to drive the trip lever 74 clockwise about pin 70, thereby moving the pin 83 connection of the upper toggle link 80 to the right as viewed in FIGS. 3 and 4.

During such movement, upper toggle link members 80 ride along an arcuate lower surface and the projecting tip of the trip links 76 to cam the lower end of the upper toggle links and the knee pin 83 leftward, shifting the line of action of the operating springs 88 to the right of the pin 83 connection to the latch lever 74, effecting collapse of the toggle linkage to open the contacts.

Figure 15:
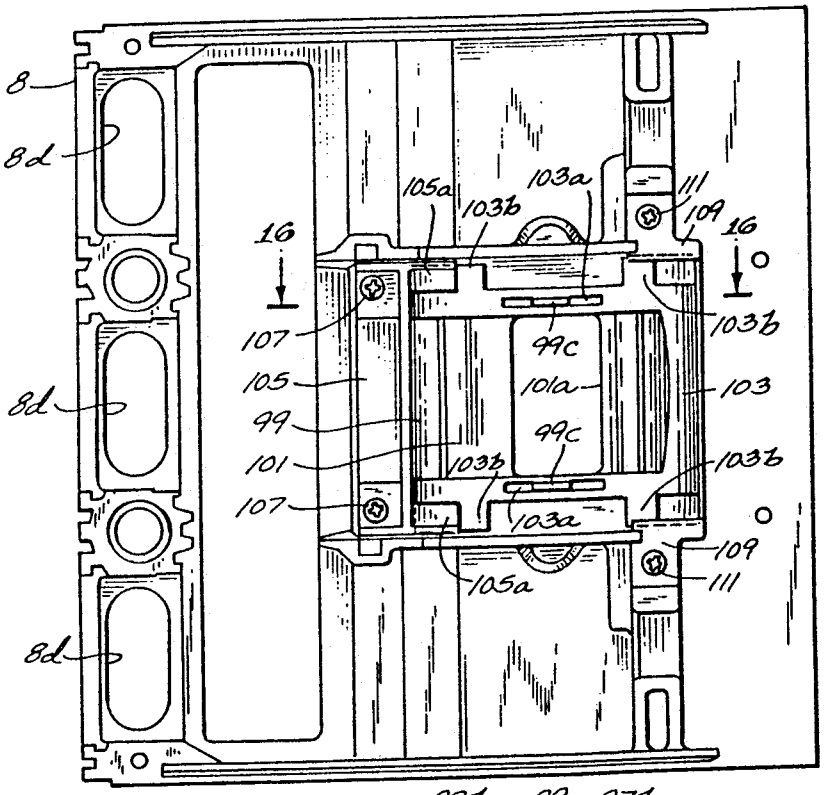
FIG. 15 is a bottom view of a molded insulating cover for the circuit breaker of this invention showing a handle opening mask arrangement.
Figure 16:
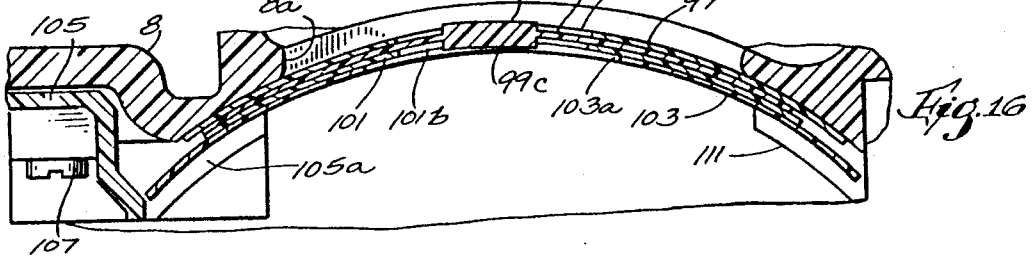
FIG. 16 is a cross sectional view taken along the line 16—16 in FIG. 15, drawn to an enlarged scale.
Figure 11:
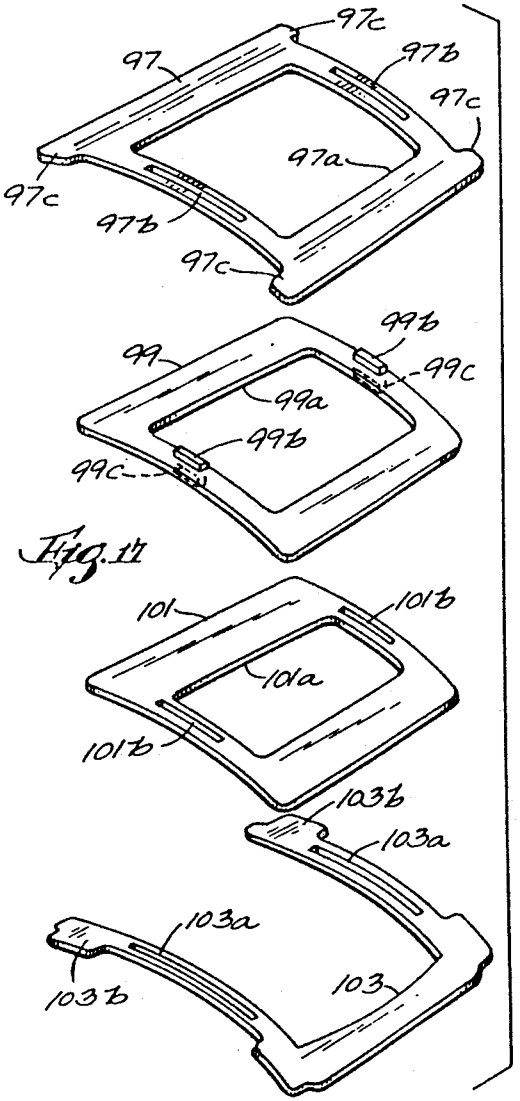
Figure 1B:
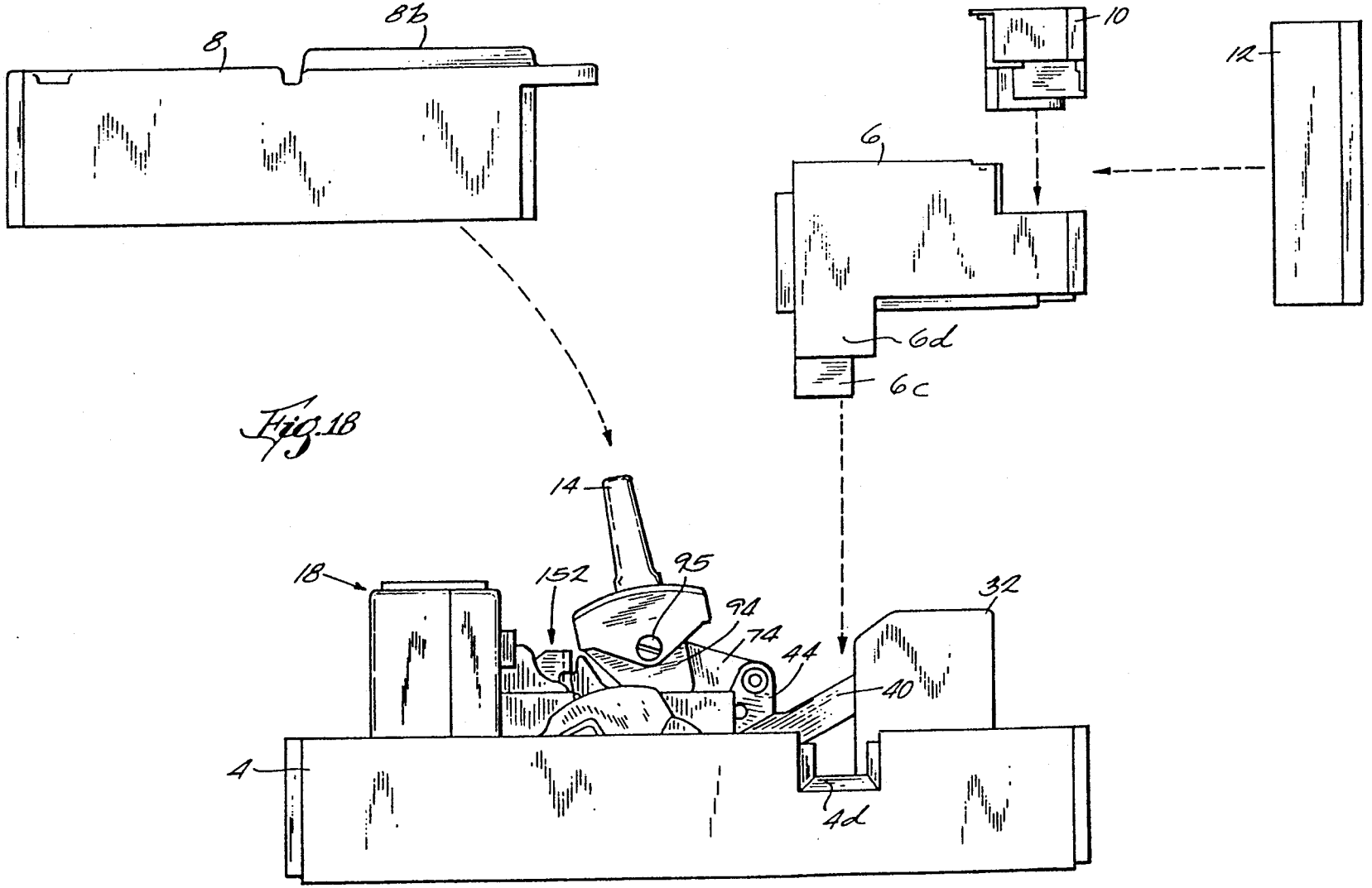

A sliding mask arrangement shown in FIGS. 15, 16 and 17 is provided in cover 8 to surround handle cap 4 and close off opening 8*a* in the cover. The mask arrangement comprises an upper mask 97, a middle mask 99, and a lower mask 101 serially stacked on a support mask 103. All of the masks are curved to match the pivoted arc of the handle. Masks 97, 99 and 101 have rectangular openings 97*a*, 99*a* and 101*a*, the respective openings having progressively smaller lengths as seen best in FIG. 17. Middle mask 99 has a pair of projections 99*b* and 99*c* (FIG. 16) projecting upward and downward, respectively, at opposite lateral sides of the opening 99*a*. Upper mask 97 has elongated slots 97*b* disposed laterally of opening 97*a* and aligned with projections 99*b*. Lower mask 101 similarly has elongated slots 101*b* disposed laterally of opening 101*a* and aligned with projections 99*c*. Support mask 103 is a U-shaped member, the legs of which contain elongated slots 103*a* aligned with projections 99*c*. As seen in FIG. 17, upper mask 97 has laterally extending tabs 97*c* at each of the four corners. Support mask 103 also has laterally extending tabs 103*b* at the four corners thereof. The masks are stacked one on top another in the described order and placed in the cover with the upper mask 97 against the underside of the cover. A molded plastic hold down 105 is attached to the underside of cover 8 by screws 107. Hold down 105 has a pair of curved projections 105*a* which overlie the tabs 103*b* and 97*c* at the OFF end of the cover. Separate hold down members 109 are attached to the underside of the cover 8 at the corners of the mask arrangement at the ON end of the cover by screws 111. Members 109 have curved projections 109*a* overlying the tabs 103*b* and 97*c* at that end.

The lower mask 101 has the smaller handle opening 101*a* of the three masks and moves generally with the handle. The handle subsequently engages a respective edge of the middle mask 99 to move that mask also. As the masks move, the slots 101*b* move relative to projections 99*c* such that the projections are near respective ends of the slots and block any attempt at manual movement of middle mask 99 to cause an end of the mask 99 to move clear of the opening 97*a* in upper mask 97, thereby providing internal access to the breaker through the cover opening 8*a*. Similarly, projections 99*b* move within the slots 97*b* of upper mask 97 to positions near one end of the slots to block manual movement of the middle mask in a direction to move an end of middle mask 99 clear of the opening 97*a* in upper mask 97.

Figure 13:
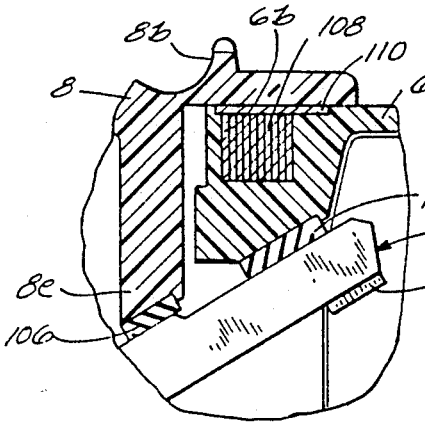
FIG. 13 is a fragmentary cross sectional view through an outer pole of the circuit breaker of this invention showing a pair of stops for the movable contact finger.

As seen in FIGS. 2–5, a rubber stop pad 102 having good shock absorbing qualities is attached to the interior of arc chamber housing 6. In normal on/off operation and in trip operation, the rubber stop pad 102 functions to arrest the movement of the movable contact finger 40 and to substantially dampen any rebound of the finger. However, in current limiting operation, the movable contact finger 40 opens with great velocity such as to cause bending of the movable contact finger when impacting the single stop pad 102. Accordingly, the lower edges 76*a* of trip links 76 function as a secondary stop for the movable contact finger 40 after the contact finger has compressed the stop pad 102 an initial amount. This provides two spaced points of impact absorption to minimize bending or other damage to the contact finger. Referring to FIG. 13, the outer poles of circuit breaker 2 have a stop pad 104 positioned on the interior of arc chamber housing 6 and a second pad 106 secured to a depending wall 8*e* of molded insulating cover 8. Pads 104 and 106 provide two spaced points of impact absorption for the movable contact fingers 40 of the outer poles. Stop pad 104 in the outer poles of the breaker is mounted higher within the arc chamber housing 6 than is the stop pad 102 in the center pole which is mounted on the end of a depending projection as best seen in FIG. 16. The operating mechanism and the space required therefor restricts the distance the center pole movable contact finger 40 may open. The magnitude of current that is interruptible by the contacts is related to the separation distance of the contacts. In a three phase system in which a three pole circuit breaker is used, the interruption capability is the combined capability of all three poles. Accordingly, by increasing the separation distance of the contacts of the outer poles, higher values of current may be interrupted by the circuit breaker 2.

Figure 19:
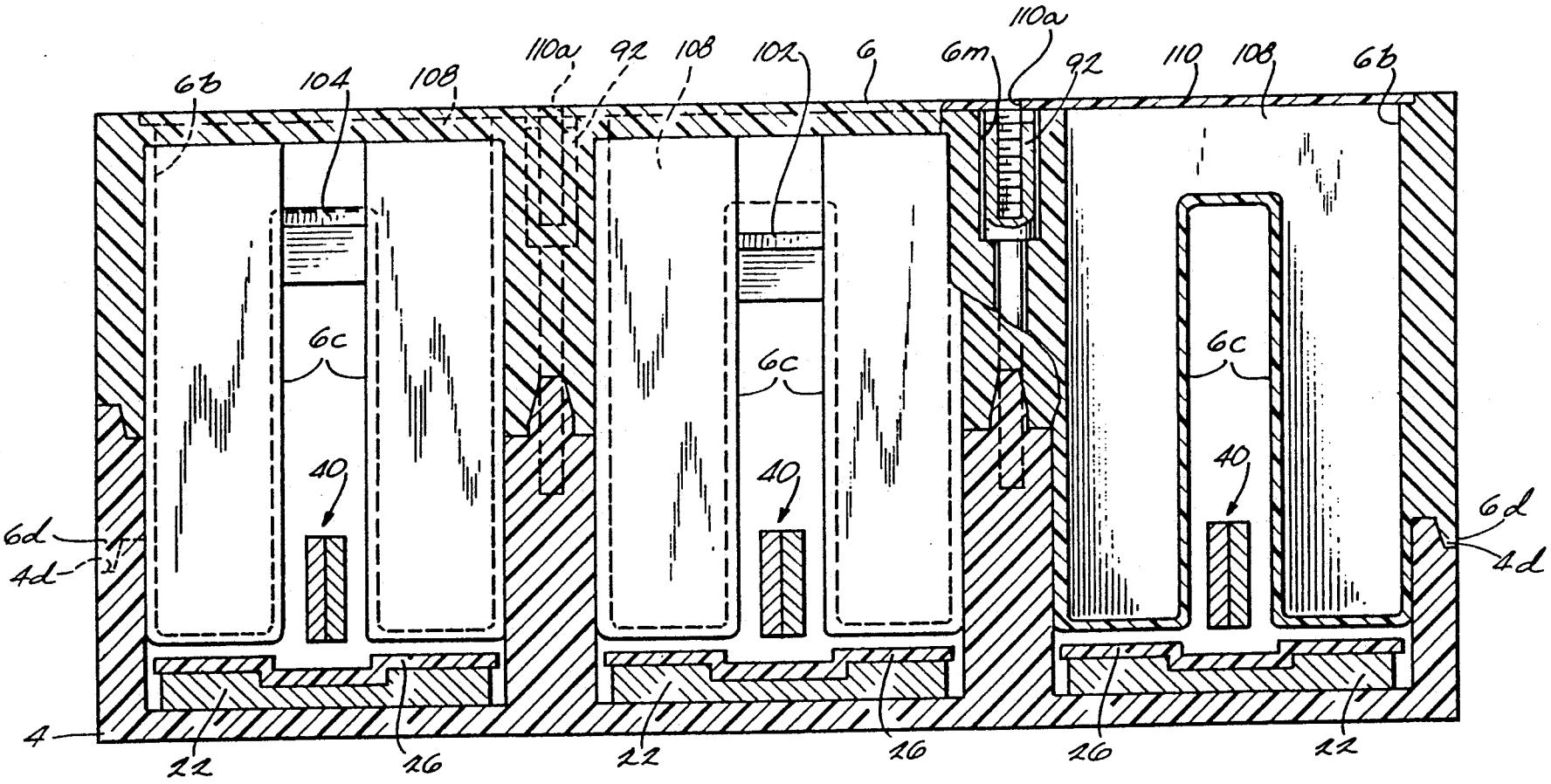
FIG. 19 is a cross sectional view taken across the width of the circuit breaker along line 19—19 in FIG. 2 showing an arc chamber housing and magnetic flux concentrator of the circuit breaker of this invention.

Arc chamber housing 6 provides increased strength for the molded housing of circuit breaker 2 as contrasted to the strength provided by a single molded cover member. The arc chamber housing is reinforced with magnetic steel flux concentrator members 108 overlying the movable contact fingers and the stop pads 102 and 104 to further increase the strength of the housing. The arc chamber housing 6 comprises a molded plastic member having an end wall 6*a* adjacent the exterior of the circuit breaker at the ON end, side walls and interior barrier members defining chambers aligned with the respective poles of the circuit breaker 2, and an interior end wall comprising a plurality of inverted U-shaped molded pockets 6*b* (FIG. 19). The legs 6*c* of the respective pockets 6*b* straddle the movable contact fingers 40 of the respective poles and have the stop pads 102 and 104 attached to the interior of the bight portion of the pocket 6*b*. Pockets 6*b* are open to the upper exterior surface of the arc chamber housing and receive the U-shaped laminated magnetic flux concentrator members 108 therein. Arc chamber housing 6 is secured to base 4 by a first pair of barrel screws 92 (FIG. 19) which extend through shouldered holes 6*m* in housing 6 between adjacent pockets 6*b* and thread into aligned holes in upstanding barriers of base 4. The barrels of screws 92 have threaded holes which receive screws 17 for securing cover 8 to arc chamber housing 6. A second pair of barrel screws 93 (FIG. 20, only one shown) extend through shouldered holes in barrier extensions of side walls of housing 6 and thread into aligned holes in base 4. The barrels of screws 93 have threaded holes which receive screws 20 for securing terminal cover 10 to housing 6. An insulating strip 110 is secured to the top exterior surface of the arc chamber housing 6 over the open pockets 6*b* and the magnetic flux concentrators 108 with an adhesive or the like. Insulating strip 110 has a pair of holes 110*a* aligned with holes in the barrels of screws 92. Holes 110*a* provide clearance for screws 17, but as may be seen in FIG. 19, are significantly smaller than the diameter of the respective barrels of screws 92. Strip 110 is secured in place after arc chamber housing 6 is attached to base 4, and accordingly provides an effective tamper-proof barrier to later removal of arc chamber housing 6 from base 4.

The side walls, interior barriers and exterior end wall 6a have structural features that overlap, extend into or receive complementally formed structured features on the upper ends of the side walls, barriers and end wall 4a of the base 4 to distribute the strength of the arc chamber housing walls to associated walls of the base 4 as well as to increase over-surface distances and provide effective sealing between conductive elements of different phases. Pressure from arc gasses within the contact separation area can be explosively powerful and can damage molded insulating housing members. It is known to reduce the height of a molded wall to increase the strength thereof. It is also known to offset a parting plane between two housing elements in a particular area to equalize the height and area of the respective walls and thereby increase the overall wall strength in the area. The ferrous material of magnetic flux concentrator members 108 provides a reinforcement to the molded housing 6. The legs 6c of pockets 6b and the legs of the U-shaped magnetic flux concentrators 108 depend deep into the base 4. The outermost legs 6c in the outer poles are adjacent sidewalls of arc chamber housing 6. Taking advantage of the reinforced strength provided by the flux concentrators 108, the side wall of the arc chamber housing 6 is offset downwardly at 6d in the area of an adjacent leg 6c of a U-shaped pocket 6b and is integrally joined to that leg along the length of the downward offset. The side wall of the molded insulating base 4 is complementally recessed at 4d to receive the offset 6d. The offset portion 6d is provided with a downwardly projecting edge that cooperatively overlaps a relieved lip along the edge of the recess 4d to impart the metal reinforced strength of the arc chamber housing 6 to the base 4 in this area.

External end wall 6a of the arc housing chamber 6 is provided with a vent opening 6e (FIG. 20) in the upper portion of the wall communicating directly with the respective chamber for venting arc gasses therethrough. End wall 6a has an upwardly open groove 6fin a ledge extending along a bottom edge of the vent opening 6e. A second groove 6g is provided in the upper exterior surface of arc chamber housing 6 along the end wall 6a. The grooves 6f and 6g provide structural interlocking with downwardly projecting ribs 10a and 10b, respectively, on terminal cover 10 and provide effective seals for blocking the flow of ionized gasses through the juncture surfaces of members 6 and 10. The grooves 6f and 6g and ribs 10a and 10b are shown in FIG. 2 to extend transversely relative to the respective poles of the circuit breaker housing. Although not shown, the respective grooves and ribs also have integral elements which are directed substantially parallel to the orientation of the respective poles, thereby to lock the terminal cover 10 to arc chamber housing 6 against movement into and out of the plane of the paper, and right and left, as viewed in FIG. 2. Base 4 and arc chamber housing 6 have barriers 4e and 6h (FIG. 2) which project from end walls 4a and 6a, respectively, between the terminals 22 of the respective poles. Barriers 4e have circular recesses which receive depending bosses on barriers 6h to block the flow of arc gasses and to increase over-surface distance between phases of the circuit breaker as well as interlock the arc chamber housing 6 to base 4.

Figure 21:
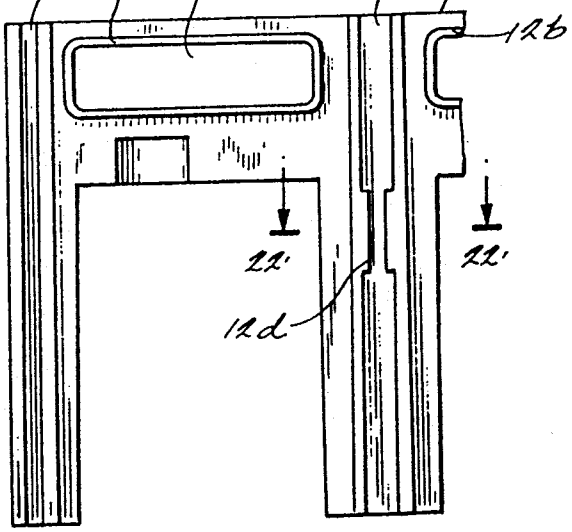
FIG. 21 is an elevational view of a back side of the extended lug cover taken in the direction of line 21—21 in FIG. 20.
Figure 10:
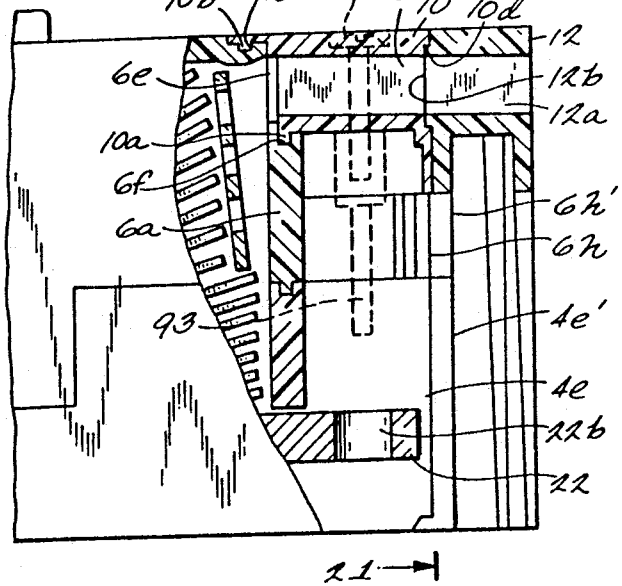
Figure 22:
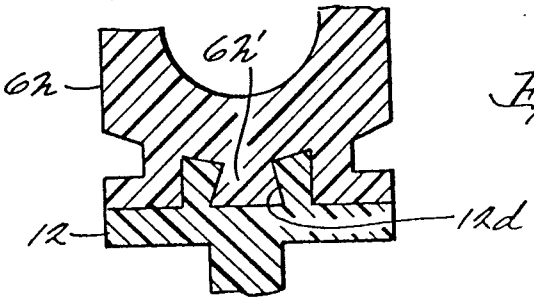
FIG. 22 is a fragmentary cross sectional view taken along the line 22—22 in FIG. 21 through a dovetail interlocking structure of the arc chamber housing and the extended lug cover.

This invention also provides for an extended lug cover when extended wiring lugs (not shown) are attached to the terminals 22 at the ON end of the circuit breaker, such wiring lugs extending beyond the barriers 4e and 6h. Extended lug cover 12 is a molded insulating member that extends the full width of the circuit breaker and is attached to the arc chamber housing 6 and the terminal cover 10 to extend insulating barriers between the projecting portions of the extended lugs. A particular interlocking arrangement between these three members securely attaches the extended lug cover 12 to the circuit breaker. Referring particularly to FIGS. 20, 21 and 22, the terminal cover 10 is provided with rectangular openings 10c which align with the vent openings 6e in the arc chamber housing 6. The openings 10c are angled slightly downwardly toward the exterior of the circuit breaker for more efficient exhaustion of the arc gasses. A peripheral recess 10d is provided around the opening 10c in the exterior face of the cover 10 as seen in FIG. 20. Extended lug cover 12 has rectangular openings 12a which align with the openings 10c in terminal cover 10. The openings 12a are angled downwardly to be aligned with and parallel to the slope of openings 10c for controlled exhaustion of the arc gasses away from conductive framework within which the circuit breaker is mounted. A peripheral rib 12b is provided around each of the openings 12a, the rib 12b being formed complementally to the recess 10d. The outer faces of barriers 4e and 6h have projecting ribs 4e' and 6h' which extend into respective grooves 12c in the interior face of cover 12 forming a labyrinth junction between the members. The center partitions of the extended lug cover disposed on opposite sides of the center pole have a dovetail portion of the groove 12c at the level of extending rib 6h' which is also formed with a dovetail shaped complementally to the portion 12d (see FIG. 22). The grooves 12e in the center barriers of extended lug cover 12 are formed generally wider above and below the dovetail section 12d than are the grooves 12c in the outer legs to accommodate the wide portion of the dovetail rib 6h'. The extended lug cover 12 is attached to the exterior face of terminal cover 10 by pressing the two members directly together in proper corresponding alignment wherein the peripheral ribs 12b are snugly received within the respective peripheral recesses 10d. The vertical grooves 12c and 12e receive vertically extending ribs (not shown) on the terminal cover 10 which are in vertical alignment with the ribs 6h' and 4e' of the arc chamber housing and base, respectively. The assembled covers 10 and 12 are then assembled to the circuit breaker housing by engaging the grooves 12c, 12e of the extended lug cover 12 with the appropriate ribs 4e' and 6h' and aligning the ribs 10a and 10b with the respective grooves 6f and 6g, and then sliding the assembled covers 10 and 12 downward onto the circuit breaker housing. In so doing, the dovetail section 12d engages and interlocks with the dovetail section 6h' and the ribs 10a and 10b engage the grooves 6f and 6g, thereby cooperatively preventing the assembled covers from being pulled away from the housing to the right and preventing the cover 12 from being separated from the cover 10. As seen in FIG. 1, a pair of screws 20 fasten the terminal cover 10 to the arc chamber housing 6. The interlocking between the recess 10d and the rib 12b prevent the extended lug cover 12 from being moved vertically separately from terminal cover 10.

Trip unit 18 located at the OFF end of circuit breaker 2 is a self-contained unit comprising a molded sub-housing comprising an insulating base 112 and an insulating cover 114 joined together in a clamshell relationship by screws 113 which extend through holes 112a and 114g (FIGS. 24 and 25) in the base 112 and thread into nuts 115. The elements of trip unit 18 are shown in a semi-exploded view in FIG. 23. The housing is essentially divided into three compartments within a main chamber, one compartment for each pole of the circuit breaker. The rear wall of the base 112 in each of the outer two compartments has a pair of aligned projections 112*b* (FIGS. 23 and 27) which have keyhole slots for receiving and pivotally supporting the trunions of an accessory actuator lever 116. The distal end of the lever is provided with a projecting nose 116*a* which bears against a rotatably mounted trip bar 132. On the opposite side of the lever 116, a cylindrical boss 116*b* (FIG. 27) projects through an opening 112*c* in the rear wall of the trip unit base 112 to be flush with an external surface of the base 112 when the accessory actuator lever 116 is resting flush against the interior surface of the back wall.

Figure 23:
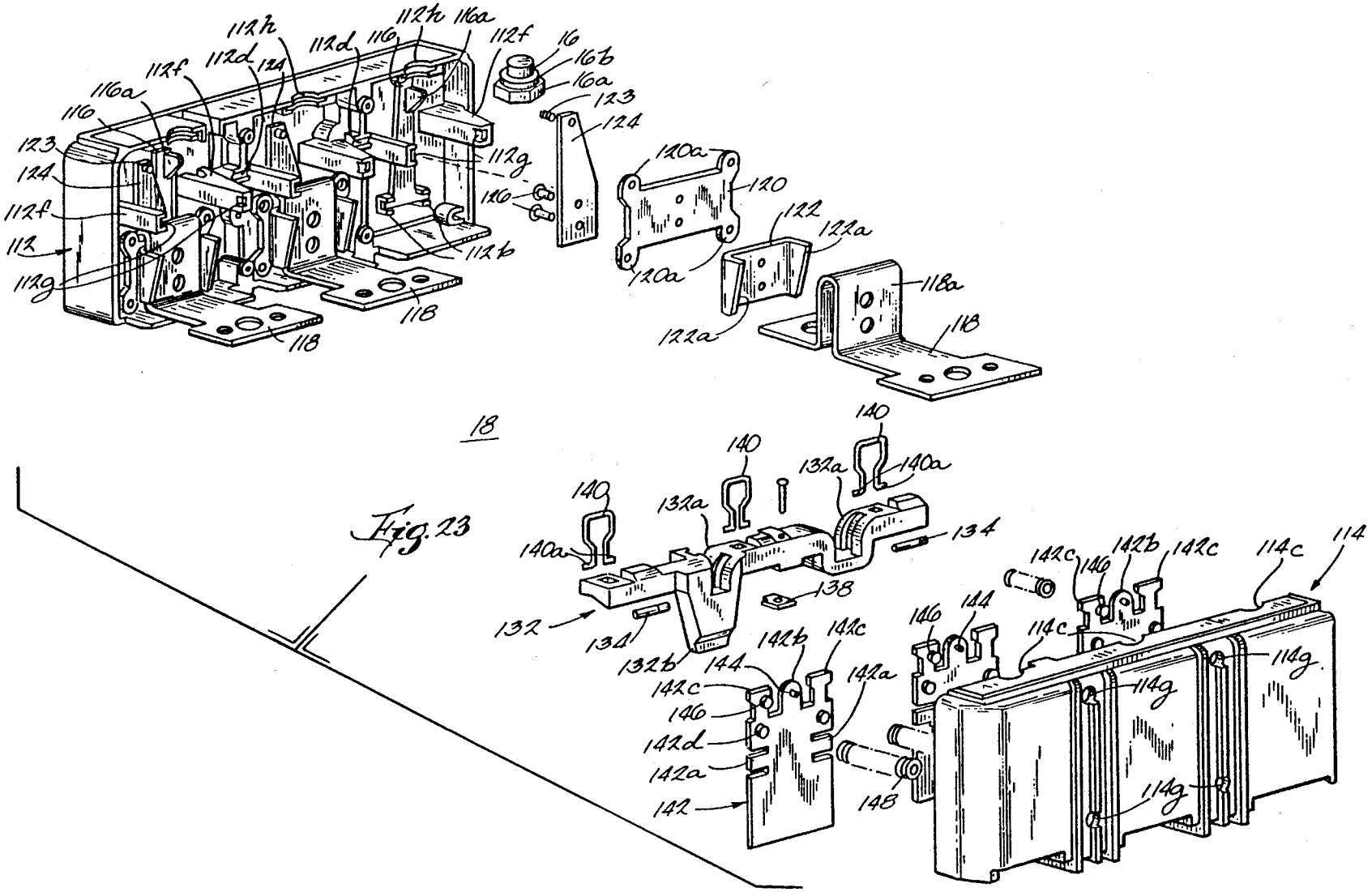
FIG. 23 is an exploded isometric view of a trip unit used in the circuit breaker of this invention.
Figure 27:
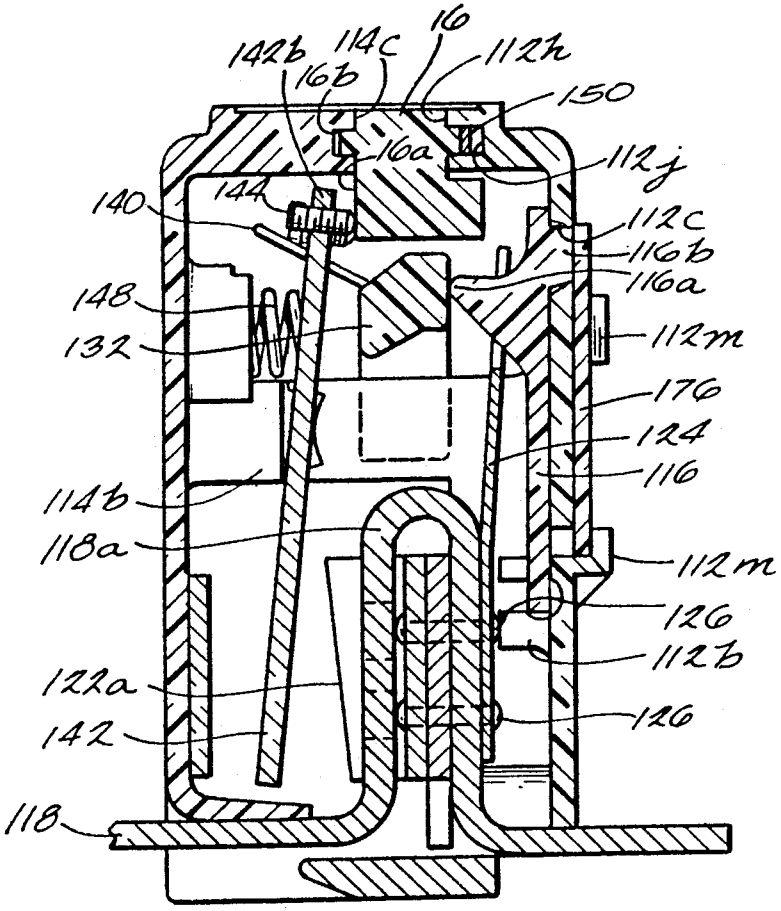
FIG. 27 is a cross sectional view taken along the line 27—27 in FIG. 24.

Each chamber of the trip unit 18 has a current sensing assembly shown exploded in FIG. 23. The assembly comprises a bus strap 118 which is generally planar but has an upstanding U-shaped portion 118*a* intermediate its ends. A magnet plate 120 having four mounting tabs 120*a* at its respective corners is disposed within the loop 118*a* against one side of the strap. A U-shaped magnetic pole piece 122 having angled edges 122*a* at the distal end of the legs is disposed against a surface of the magnet plate 120 also within the loop 118*a* of the bus strap 118. A bimetal strip 124 is positioned against an outer surface of the same leg of the loop 118*a* as the magnet plate 120 is positioned and the four elements 118, 120, 122 and 124 are secured together by a pair of rivets 126. The back wall of the base 112 is provided with an opening in each compartment through which one end of the bus strap 118 projects to the exterior. As seen in FIG. 27, the lower end of the cover 114 is open in each of the compartment areas to permit the other end of the bus strap 118 to project exteriorly of the trip unit housing. The current sensing assemblies are secured in the base 112 by two or more screws 128 (FIG. 21) which project through openings in the back wall of the base and take into threaded holes in respective ones of the mounting tabs 120*a* on the magnet plate 120. The top two mounting tabs 120*a* for the magnet plate located in the center chamber are secured in the trip unit housing by thread cutting screws 130 (FIG. 21) which are turned into appropriate holes in the base 112 from the inside of the housing because a latching assembly mounted on the exterior surface of the base 112 overlies the location of the upper mounting tabs 120*a* for the magnet plate in the center compartment.

Figure 25:
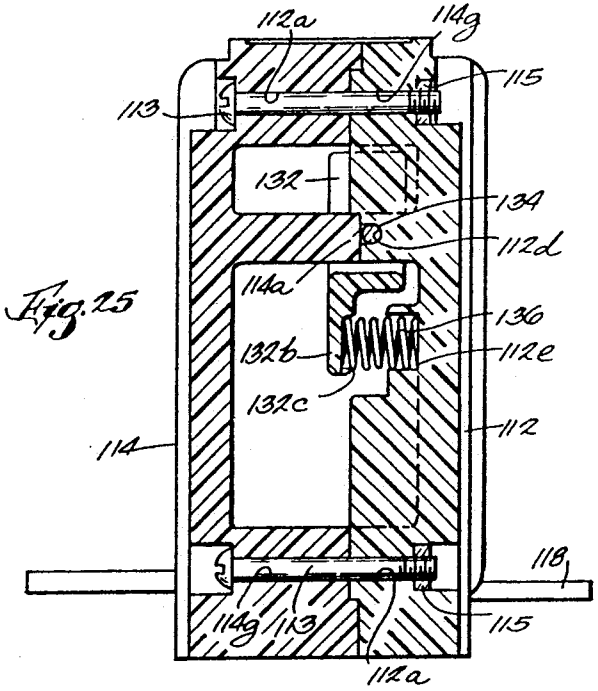
FIG. 25 is a cross sectional view taken along the line 25—25 in FIG. 24.
Figure 26:
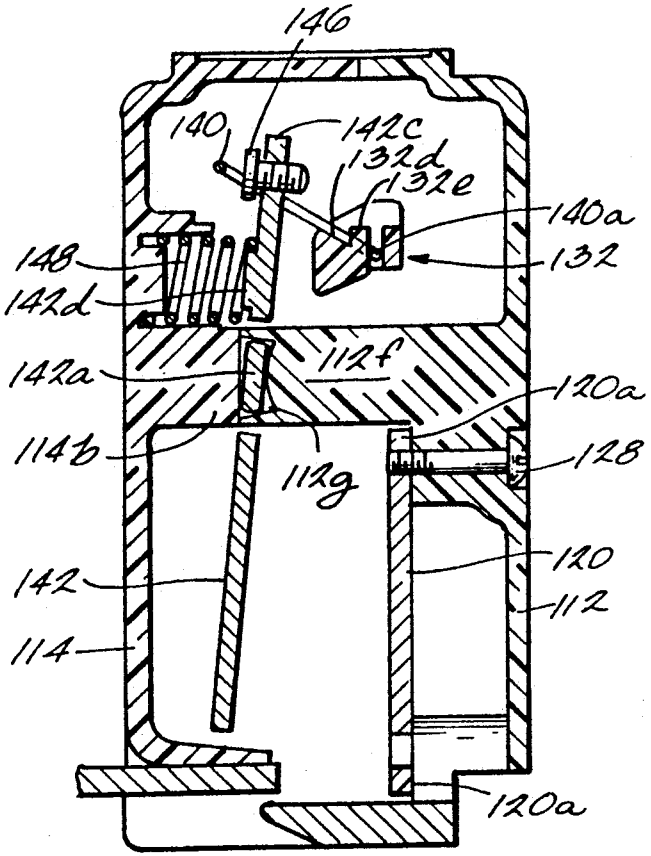
FIG. 26 is a cross sectional view taken along the line 26—26 in FIG. 24.
Figure 30:
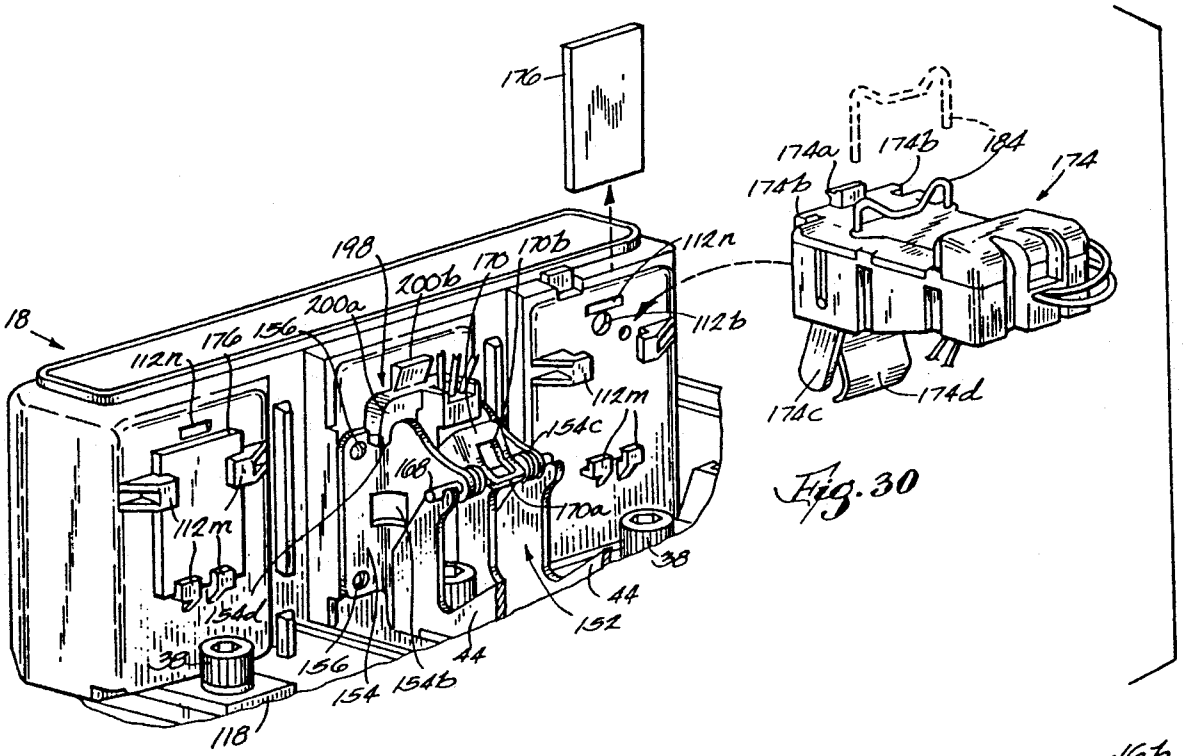
FIG. 30 is an isometric view of a trip unit and a fragmentary portion of the base and accessory devices installed and exploded away from the trip unit.

The trip bar 132 is an irregularly shaped molded insulating member that extends across the three compartments of the trip unit 18. Trip bar 132 has two U-shaped offset depending portions 132*a* which align with semicylindrical journals 112*d* formed in projections in barriers dividing the compartments of the trip unit base. A pair of pins 134 are mounted in aligned holes formed in opposite legs of the offset U-shaped portions 132*a* and are captivated in these portions by C-clips attached to the pin to prevent the pin from sliding completely through an opening in either leg. The pins 134 serve as axles for rotatably mounting the trip bar 132 in the journals 112*d*. One of the depending U-shaped projections has a further depending extension 132*b* containing a circular recess 132*c* molded in one side to position one end of a helical compression spring 136 (FIG. 25). The opposite end of compression spring 136 is positioned in a corresponding cylindrical recess 112*e* formed in the back wall of trip unit base 112. Compression spring 136 provides a clockwise bias to trip bar 132 as viewed in FIG. 25. Corresponding projections 114*a* (FIG. 25) on cover 114 abut the projections of the base 112 in which the journals 112*d* are formed to complete the bearing structure for the axle pins 134 and retain the trip bar 132 mounted within the trip unit. A metal latch plate 138 is riveted to the trip bar 132 in the center compartment between the U-shaped depending portions 132*a* for engagement by a trip lever of the latching mechanism as will be more fully described hereinafter. Three U-shaped wire bails 140 are attached to the trip bar 132 at points aligning with the left-hand side of each compartment as viewed in FIG. 24. The trip bar has a triangular shaped recess 132*d* (FIG. 26) for each wire bail 140 and has openings in the side walls of each recess at the interior corner of the recess for receiving outwardly formed ends 140*a* (FIG. 23) of the legs of the U-shaped bails. Bails 140 are assembled to trip bar 132 by compressing the legs together and inserting the free ends of the legs into the recess 132*d* along an upstanding rear wall of the recess, whereupon the legs may be released to permit the ends 140*a* to be received within the openings in the side walls of the recess. A cylindrical upstanding pin 132*e* (FIG. 26) is molded in the triangular recess to prevent the legs of the bail 140 from being compressed when the bail is in its forwardly extending operating position to prevent inadvertent removal or falling out of the bail 140 from trip bar 132.

Figure 24:
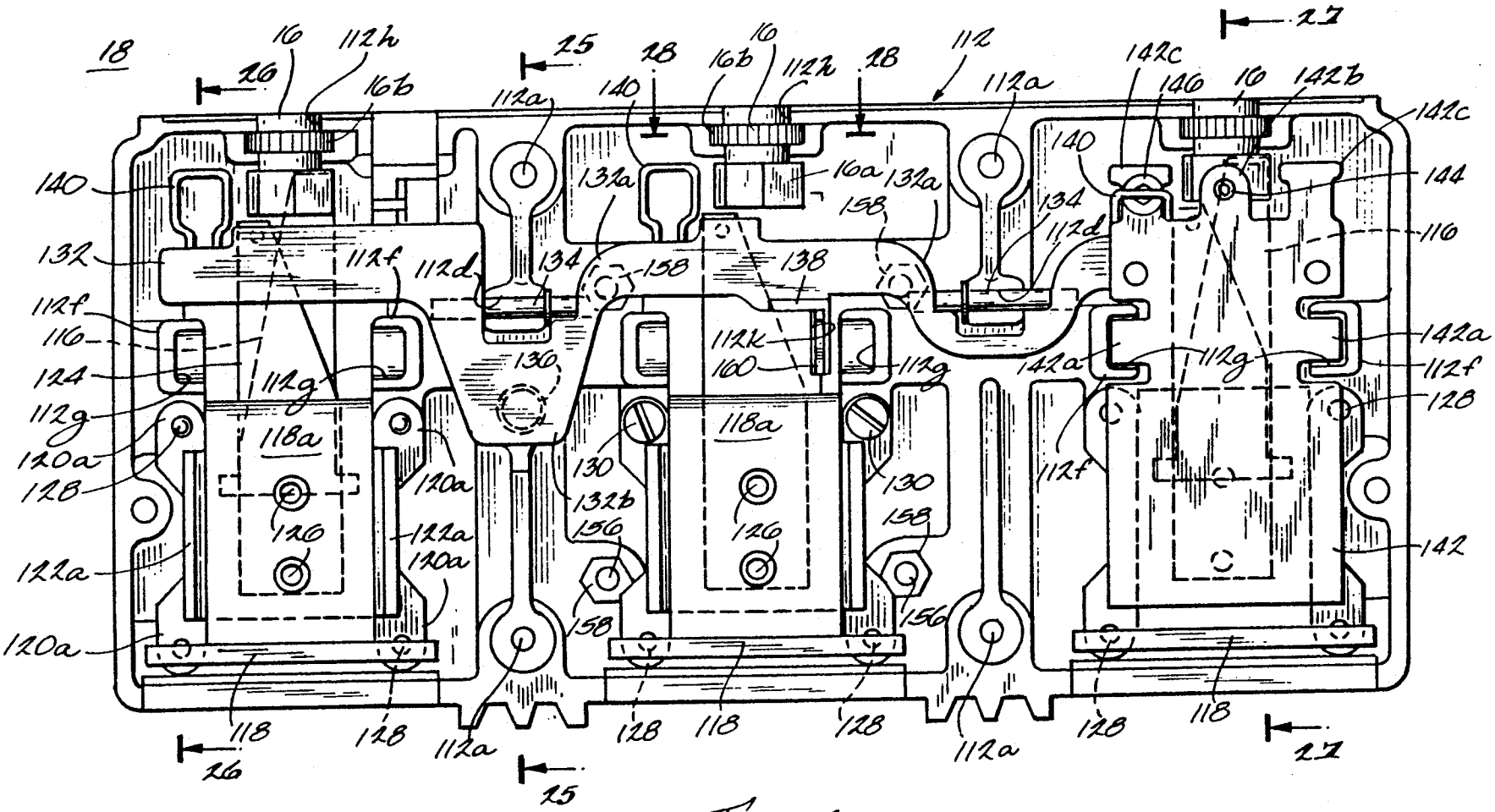
FIG. 24 is an elevational view of the trip unit of FIG. 23 with the cover and certain elements removed.

Each of the current sensing assemblies has a magnetic armature 142 associated therewith. One armature is shown in FIG. 24 and one is also fully shown in isometric view, in FIG. 23. The armature 142 is essentially a rectangular member having a pair of laterally directed tabs 142*a* which serve as an axle for the armature. The trip unit base 112 has cooperating pairs of forwardly extending projections 112*f* in each compartment. The distal ends of the cooperating projections 112*f* are provided with pockets 112*g* that are open to the forward face of the projection and toward the adjacent cooperating projection. The bottom surface of each pocket 112*g* is arcuately formed with a forwardly facing crest (FIG. 23). The flat lateral tabs 142*a* of armature 142 are disposed within the respective pockets 112*g*. The armature 142 is prevented from displacement in a transverse plane by the walls of the respective pockets, but is permitted to pivot or rock on the crest of the arcuate bottom surface of the pocket. Aligned projections 114*b* on the cover 114 overlie the ends of the projections 112*f* of the base 112 to retain the tabs 142*a* of the armature in the respective pockets 112*g*, thereby maintaining the armatures 142 assembled to the trip unit 18. The upper end of each armature is provided with a center upstanding tab 142*b* having a threaded hole in which is inserted a cap screw 144. A pair of upstanding tabs 142*c* are provided on the armature at opposite sides of the center tab 142*b*. A left-hand one of the tabs 142*c* also has a threaded opening in which is threaded a cap screw 146 having a large disc-shaped head. Screw 146 preferably has an internal tool recess such as a hex or tore type as contrasted with a slotted screwdriver recess that would communicate with the outer edge of the head. The bight portion of the U-shaped bail 140 of trip bar 132 is positioned around the outer tab 142*c* and the head of cap screw 146 and is engaged by the head of screw 146 when the armature 142 is attracted to the pole piece 122. The screw 146 provides adjustment of the point at which the armature 142 engages the bail 140 and moves the trip bar 132 when the trip unit 18 is magnetically operated. A screwdriver slot in the end of screw 146 could upset the magnetic trip adjustment if the screwdriver slot was aligned such that the bail 140 could enter the slot.

Figure 28:
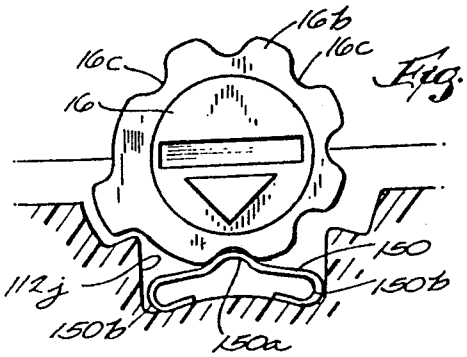
FIG. 28 is a fragmentary cross sectional view taken along the line 28—28 in FIG. 24 showing a detent spring for a magnetic trip adjustment knob.

Armature 142 is provided with a pair of offset bosses 142*d* (FIG. 26) which align one end of a pair of helical compression springs 148 which are mounted in the cover 114 by engagement of their respective opposite ends within suitable recesses molded into the cover 114. Springs 148 provide a clockwise bias to the armature 142 as viewed in FIG. 27. The end of set screw 144 bears against a cam surface 16*a* of magnetic gap adjustment knob 16 which is rotatably mounted in cooperating semicylindrical recesses 114*c* and 112*h* formed in the mating surfaces of the trip unit cover 114 and base 112. An improved detent spring 150 for the magnetic gap adjustment knob 16 is mounted in a pocket 112*j* (FIG. 28) in the base 112. The bottom surface of the pocket 112*j* is shaped arcuately forward. Spring 150 is a leaf spring having a forwardly projecting central projection 150*a* which is semicylindrically shaped. The outer ends of spring 150 comprise rearwardly disposed U-shaped bends 150*b*. When inserted in the pocket 112*j*, the arcuate bottom wall of the pocket engages the free ends of the respective U-shaped bends 150*b*, deflecting them forwardly and imparting a forward thrust projection 150*a*. Adjusting knob 16 has an enlarged flange 16*b* having a series of detent recesses 16*c* therein which engage the projection 150*a* of spring 150 and compress the spring against the bottom wall of pocket 112*j*. The arcuate surface of the bottom wall of pocket 112*j* distributes the forces in spring 150 such that central projection 150*a* is resiliently urged into the respective recesses 16*c* providing definite rotational positions for knob 16. By rotating the knob 16 from the exterior of the trip unit, the cam 16*a* operates through the cam follower set screw 144 to rotate the armature for increasing or decreasing the magnetic gap between the armature 142 and the pole piece 122, thereby increasing or decreasing the sensitivity of the magnetic trip.

Figure 29:
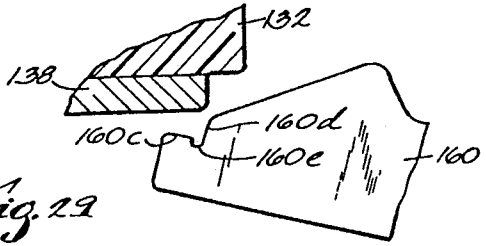
FIG. 29 is a fragmentary view of latching portions of a trip lever and trip bar drawn to an enlarged scale.
Figure 33:
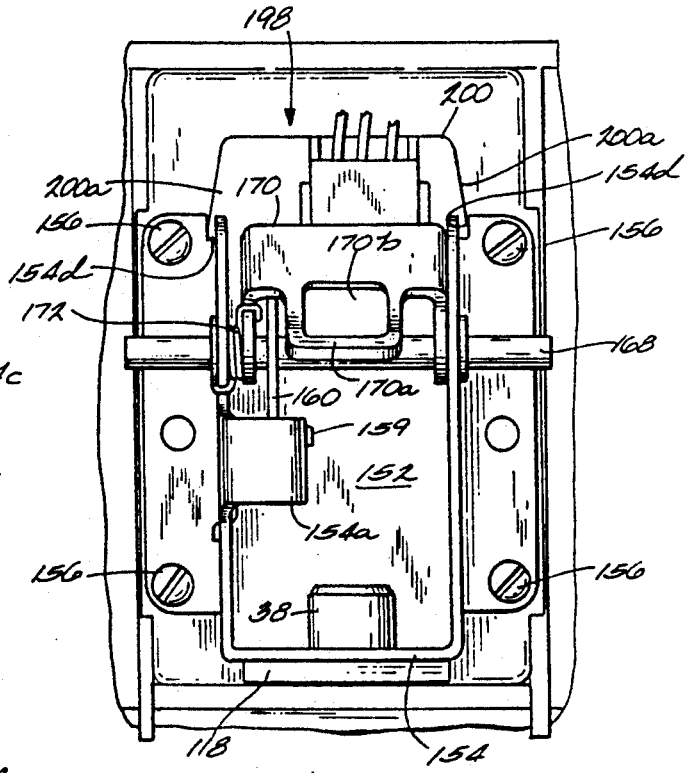
FIG. 33 is a fragmentary elevational view of the latching mechanism and accessory device shown in FIG. 32 when viewed from the right-hand side thereof.
Figure 37:
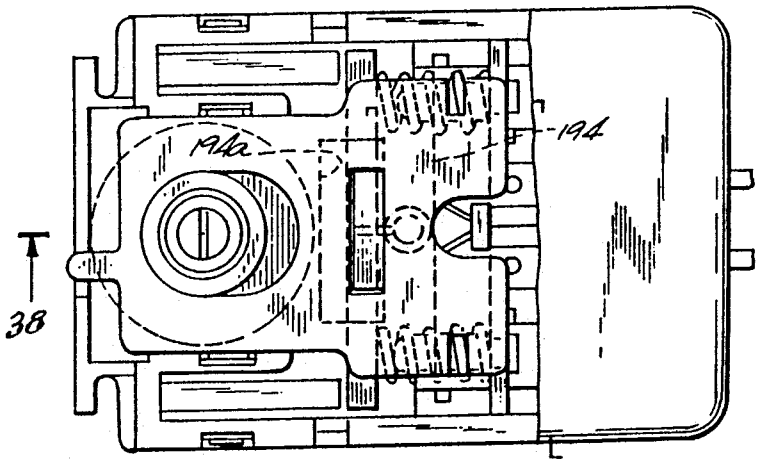
FIG. 37 is a top view of another accessory device similar to that device shown in FIG. 35.

A latching mechanism 152 (FIGS. 2, 30, 32–34) is attached to the exterior surface of the back wall of the base 112 of the trip unit 18. The latching mechanism 152 comprises a U-shaped bracket 154 wherein the legs of the U-shaped bracket have outwardly directed flanges along vertical reaches thereof which have holes in the opposite ends for attaching the latching mechanism 154 to the base 112 by four screws 156 (FIG. 33) which pass through the holes and corresponding holes in the trip unit base to take into nuts 158 (FIG. 24) received within complemental hexagonal pockets on the interior of the base 112. One leg of bracket 154 has a tab 154*a* offset toward the opposite leg of the bracket and terminating in a rearwardly extending leg that extends toward the molded insulating base 112 of the trip unit, thereby forming a U-shaped tab with the leg of bracket 154 from which the tab is offset. The tab 154*a* and the bracket leg have a pair of aligned holes for receiving a rivet 159 to serve as a pivot for a trip lever 160. The trip lever has a horizontally disposed U-shape base which has a pair of aligned holes 160*a* in opposite legs of the U for also receiving the rivet 159 therethrough. One leg 160*b* of the U-shaped base portion of trip lever 160 extends upwardly and is offset at substantially a right angle to project through an opening 112*k* in the back wall of trip unit base 112. The distal end of the offset leg portion 160*b* of trip lever 160 is particularly configured to engage with the latch plate 138 on the trip bar 132. The end has a forwardly projecting lower lip 160*c* joined to a vertical section 160*d* by a relieved radiused portion 160*e* (FIG. 29). The distance from the surface of lower lip 160*c* to the upper corner of the vertical section 160*d* is controlled in manufacture of the trip lever 160 to precisely and repeatedly effect the same engagement between the trip lever 160 and the latch plate 138.

Figure 5:
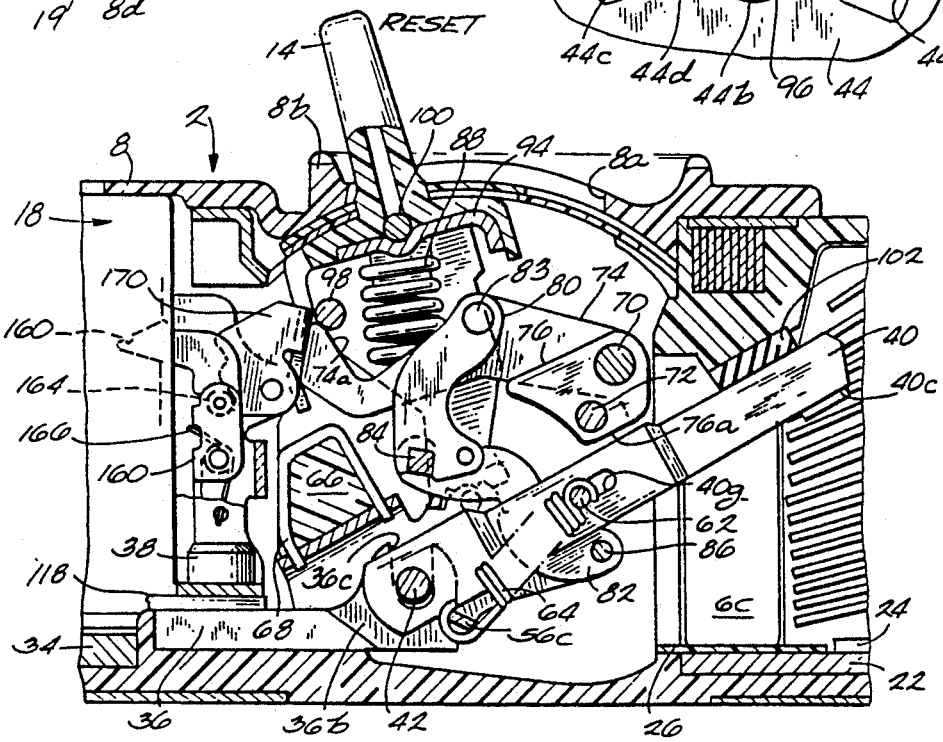
FIG. 5 is a fragmentary cross sectional view similar to FIG. 3 showing the circuit breaker in a RESET position.
Figure 34:
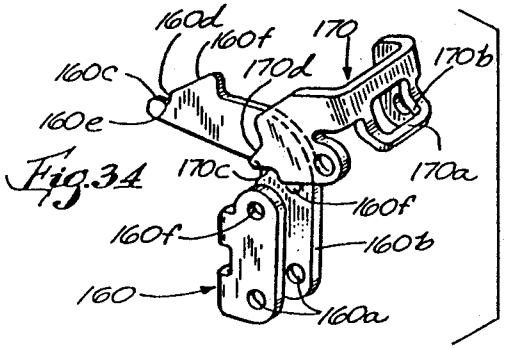
FIG. 34 is an exploded isometric view of a latch and a trip lever of the circuit breaker of this invention.
Figure 12:
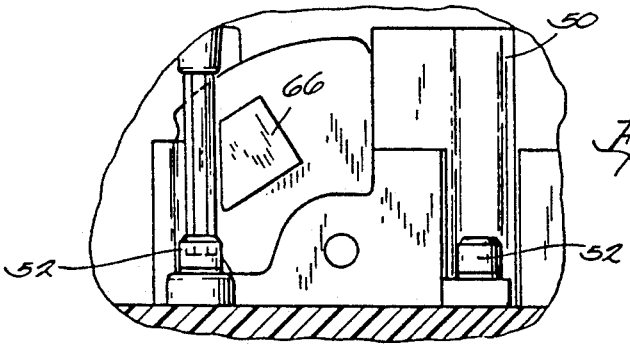
FIG. 12 is a fragmentary cross sectional view showing a spacial relationship between a terminal screw and a tool for such screw.

A headed pin 162 is disposed between a pair of aligned holes 160*f* at the upper end of the U-shaped base portion of the trip lever 160 and retained so assembled by a C-clip. Pin 162 serves to mount a roller 164 between the legs of the U-shaped base portion of trip lever 160. The head of the pin 162 is disposed within a rectangular opening 154*b* in one leg of bracket 154 and functions to limit movement of the trip lever 160 away from the back wall of the base 112 by engagement of the head of the pin with one edge of the rectangular opening 154*b*. The trip lever is biased clockwise as viewed in FIG. 2 by a torsion spring 166 which is disposed around the rivet 159, one end of which is anchored in one leg of bracket 154 and the opposite end of the spring 166 being anchored in an opening in the U-shaped base portion of the trip lever 160. The upwardly extending legs of the U-shaped 154 bracket have a pair of projections 154*c* extending away from the back wall of the molded base 112 of the trip unit, each projection 154*c* having a hole therein aligned with the corresponding hole in the other projection for receiving a pin 168 therethrough. A U-shaped latch 170 has a pair of holes through the legs thereof which are also disposed over the pin 168 to pivotally mount the latch 170 on the pin 168. Pin 168 is retained in the bracket 154 by appropriate C-clips. A tab 170*a* depends from the bight portion of latch 170 at a shallow outward angle with respect to the bight portion. A rectangular opening 170*b* is provided in the tab 170*a* to create a latch surface along an upper edge of the opening for the latch lever 74. One leg of the U-shaped latch 170 is profiled to have another latch surface 170*c* which engages the roller 164 as seen in FIGS. 5 and 34. Immediately adjacent the latch surface 170*c* is a recessed detent surface 170*d* which is also configured to engage the roller 164. The latch surface 170*c* and the detent surface 170*d* create an apex between the two surfaces which serves to snap the detent surface 170*d* into engagement with the roller 164 upon appropriate motion of the trip lever 160. A second torsion spring 172 is positioned around the pin 168 and engages the latch 170 and the bracket 154 for providing a counterclockwise rotational bias on the latch 170 as viewed in FIG. 2.

The operation of the circuit breaker 2 will now be described. Referring to FIG. 2, the circuit breaker is shown in its OFF condition wherein operating handle 94 is at rest in an indicating position near the left-hand end of opening 8*a* in cover 8. A latching lip 74*b* on the distal end of latch lever 74 is in engagement with latch 170, urging the latch 170 counterclockwise about pin 168 and thereby urging the latch surface 170*c* against roller 164. Engagement of trip lever 160 with latch plate 138 of the trip bar 132 blocks counterclockwise movement of trip lever 160 and therefore roller 164 cannot move outwardly along the latch surface 170*c* to release the latch. With the latching mechanism so engaged, the operating handle 94 can be moved from the OFF position to the ON position as shown in FIG. 3 to effect straightening of the toggle linkage and closure of the movable contact 40*c* upon the stationary contact 24.

Traverse of handle 94 to the OFF position effects collapse of the toggle linkage to the position shown in FIG. 2, and resultant separation of the movable contact 40*c* from the stationary contact 24.

In the event of an over current or fault current condition in any one phase of the circuit breaker, the abnormal current is detected either by the bimetal 124 or by the magnetic armature 142. In the event of a prolonged over current condition of relatively low magnitude, the bimetal 124 heats up and deflects to the left as viewed in FIG. 2 whereupon the adjusting screw 123 engages upstanding projections on trip bar 132 above the trunions 112*d* to impart a counterclockwise rotation to the trip bar 132. If a large fault current occurs such as a direct short circuit, the magnetic members of the current sensing unit operate to attract the lower end of armature 142 against the angled surfaces 122*a* of the pole piece 122, imparting a counterclockwise rotation to the armature 142 as viewed in FIG. 2. This motion drives the cylindrical face of adjustment screw 146 into the bight portion of bail 140, pulling the bail to the left as viewed in FIG. 2. This motion also imparts a counterclockwise rotation to the trip bar 132 by pulling on the trip bar above the pivot provided by the trunions 112*d*. Counterclockwise rotation of trip bar 132 moves the edge of the latch plate 138 upwardly along the vertical surface 160*d* of the offset end of trip lever 160. The pivot point for the trip bar 132 and for the latch plate 138 is approximately coplanar with the lower surface of latch plate 138 so that movement of the corner of the latch plate along the surface 160*d* is substantially parallel to the vertical surface 160*d*, although it curves away from the surface 160*d* due to the pivotal movement of the trip bar.

As the latch plate 138 moves above the upper end of the vertical surface 160*d*, it releases trip lever 160 for counterclockwise movement wherein a camming surface 160*f* moves underneath the latching corner of the latching plate 138. The counterclockwise movement of trip lever 160 moves roller 164 along the latch surface 170*c* until the apex between latch surface 170*c* and detent surface 170*d* passes over-center of the roller, whereupon latch 170 rotates counterclockwise to bring detent surface 170*d* into engagement with roller 164. This counterclockwise movement of latch 170 is sufficient to move the latching surface at the upper end of rectangular opening 170*b* free of the lip 74*b* of latch lever 74, thereby releasing the distal end of latch lever 74 and permitting it to pivot clockwise about the pin 70. In so doing, latch lever 74 carries the pivotal connection of the upper end of the toggle link over-center of the line of action of the operating spring 88, causing collapse of the toggle linkage and opening of the movable contact fingers to the position shown in FIG. 4.

Figure 4:
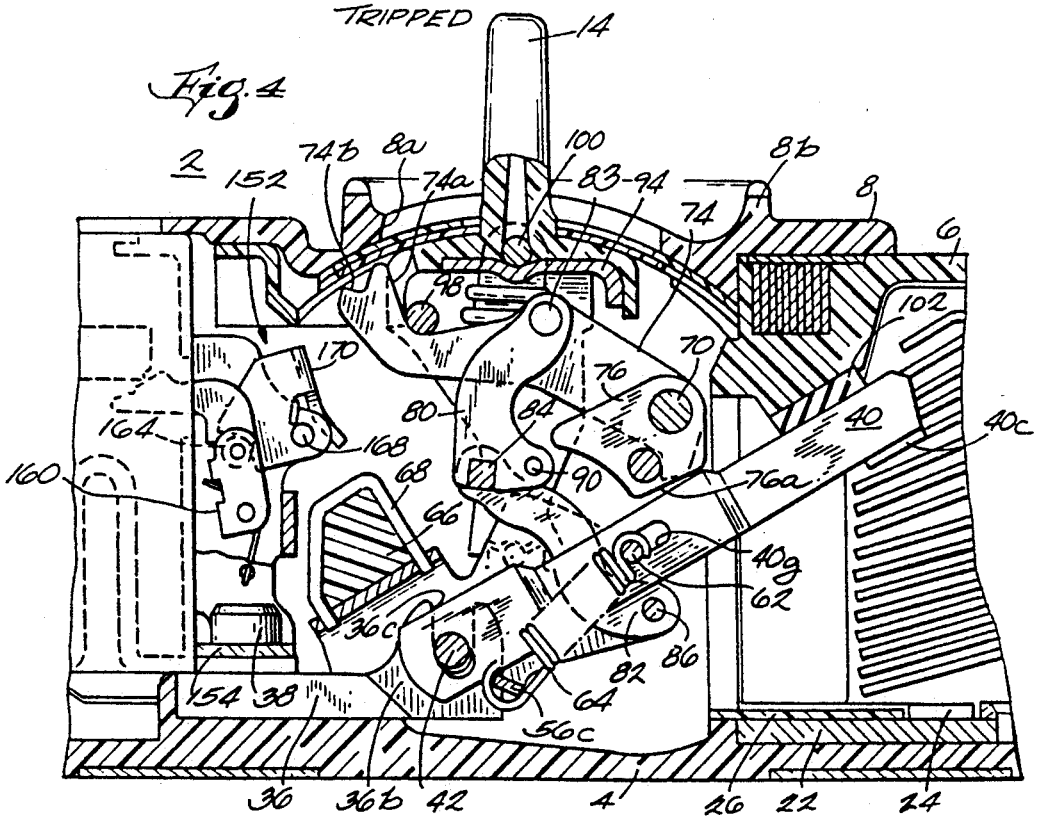
FIG. 4 is a fragmentary cross sectional view similar to FIG. 3 showing the circuit breaker in a TRIPPED position.

The movement of the various elements of the operating mechanism to the FIG. 4 TRIPPED position cause the cam surface 74*a* of latch lever 74 to engage transverse pin 98 of the handle to cam the operating handle 94 to the right to the TRIPPED indicating position as shown in FIG. 4. The circuit breaker 2 is RESET from the FIG. 4 position to the FIG. 2 position by moving the operating handle 94 to the RESET position shown in FIG. 5. In so doing, pin 98 drives against the surface 74*a* of latch lever 74 to rotate the latch lever counterclockwise and bring the distal end of the latch lever down against the tab 170*a* of latch 170. The distal end of latch lever 74 enters the rectangular opening 170*b* of latch 170 and continued movement of the latch lever rotates the latch 170 clockwise. This rotation of latch 170 drives trip lever 160 counterclockwise by the movement of the detent recess 170*d* against roller 164 until the apex between the detent surface 170*d* and the latch surface 170*c* passes over-center of the roller 164. Trip lever 160 then is biased clockwise along the latching surface 170*c*, causing the angled surface 160*f* to move along the latch plate 138 of the trip bar 132 until the latch plate is moved over the upper corner of the vertical surface 160*d* and comes to rest against lower lip 160*c*. With the latching mechanism thus engaged, latch 170 is prevented from counterclockwise movement and it firmly retains the distal end of latch lever 174 from movement. As described hereinbefore, the changing pivot point for the movement of the operating handle 94 assist the handle in moving to the OFF position shown in FIG. 2 when the latch lever and latching mechanism are RESET.

Figure 31:
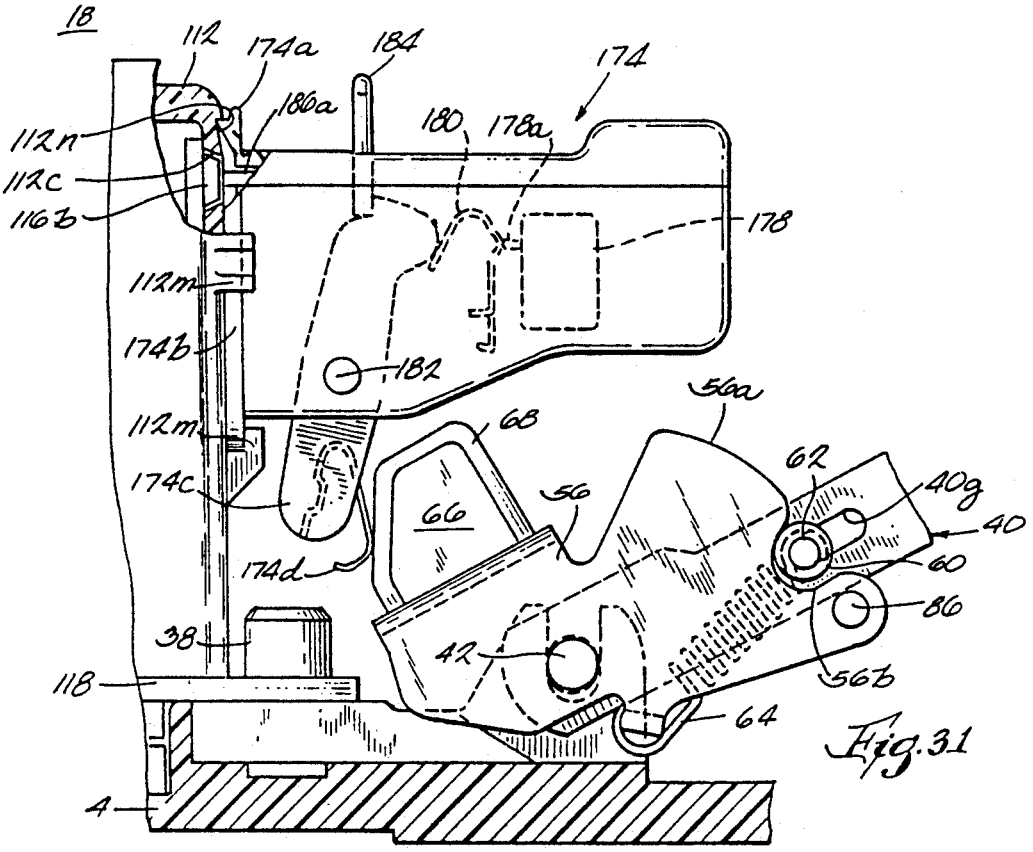
FIG. 31 is a fragmentary view partially in cross section of one of the accessory devices of FIG. 30 shown mounted on the trip unit.
Figure 32:
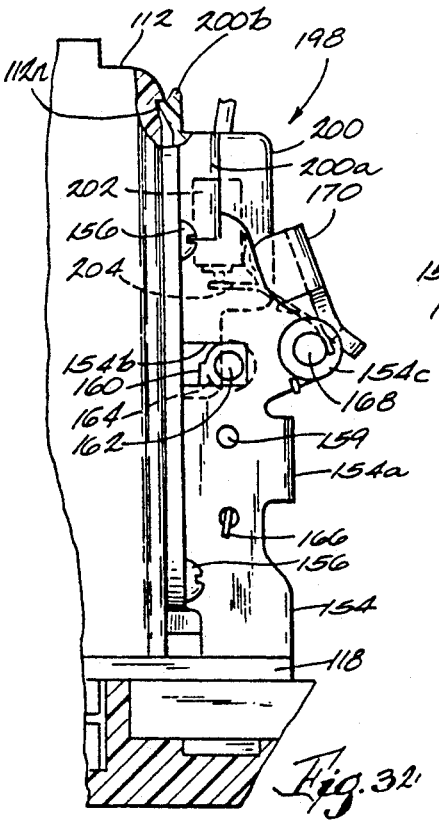
FIG. 32 is a fragmentary cross sectional view of another of the accessory devices shown mounted on the latching mechanism and the trip unit.

The back wall of the molded base 112 of the trip unit 18 has a plurality of molded tabs 112*m* (FIGS. 30 and 31) offset from the plane of the back surface for slidably receiving complemental formations on an accessory device 174 for circuit breaker 2 such as an under-voltage release, shunt trip or the like. At the top of each chamber, the back surface of trip unit base 112 is provided with a shallow triangular recess 112*n* which cooperatively receives a flexible latch 174*a* on the accessory housing to latch the accessory firmly to the housing of the trip unit 18. If an accessory device 174 is not utilized, a cover plate 176 (FIG. 30) is slid into the tabs 112*m* to cover openings 112*c* in the wall of trip unit base 112. While the cover plate 176 could be a molded member with a flexible latch similar to the latch 174*a* of the accessory units, it is preferable to use a flat piece of phenolic material or the like and to secure it in place by a drop of sealant material at the upper surface forming a temporary bond between the cover plate 176 and the trip unit housing. The housing of accessory 174 is provided with a flange 174*b* that is received within the tabs 112*m* in the same manner as the cover plate 176. Resilient latch 174*a* preferably is an integrally molded element of the accessory housing. Accessory 174 has a pair of depending levers 174*c* for actuation of the accessory by movement of the operating mechanism of the circuit breaker. The levers 174*c* have a leaf spring 174*d* suspended between their lower ends which bears against the strap 68 securing the shaft 66 to the frame 56. This provides a resilient connection between the shaft 66 and the accessory actuator 174*c*. As seen in FIG. 31, the accessory device 174 contains a snap action switch 178 which has a depressible plunger 178*a*. A leaf spring 180 is attached within the accessory 174 to provide a resilient over-travel connection between the internal end of actuator levers 174*c* and plunger 178*a*. The springs 174*d* and 180 bias actuator levers 174*c* counterclockwise about pivot point 182. Movement of the operating mechanism and contact assembly to a contact open position pivots frames 56 counterclockwise about the respective axle pins 42 to move shaft 66 toward trip unit 18. This moves shaft 66 and strap 68 against leaf spring 174*d* to pivot the upper end of actuator levers 174*c* against spring 180, depressing the plunger 178*a* of switch 178.

During installation of the accessory 174, if the levers 174*c* are rotated counterclockwise such that the upper ends are free of spring 180, the lower end of the levers 174*c* and the spring 174*d* could become positioned on the right side of shaft 66. In that position, the accessory device 174 would not work and the accessory and/or the circuit breaker could become damaged. To ensure that the actuator levers 174c are in a proper position for installation of the accessory to the circuit breaker, a retaining loop 184 is provided which is inserted through openings in a molded insulating cover of the accessory housing to engage the upper ends of levers 174c and hold them against the bias of spring 180, thereby holding the levers in a proper position for installation in the circuit breaker. Once the accessory 174 is installed, retaining loop 184 is removed, thereby freeing the actuator lever for movement.

Figure 38:
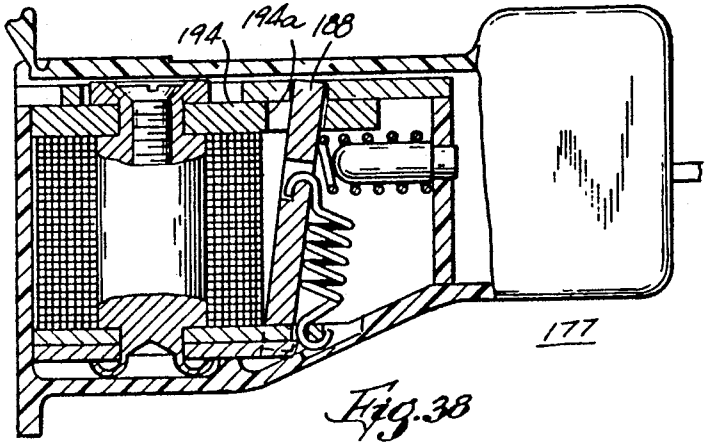
FIG. 38 is a cross sectional view of the accessory device shown in FIG. 37 taken along the line 38—38 in FIG. 37.
Figure 35:
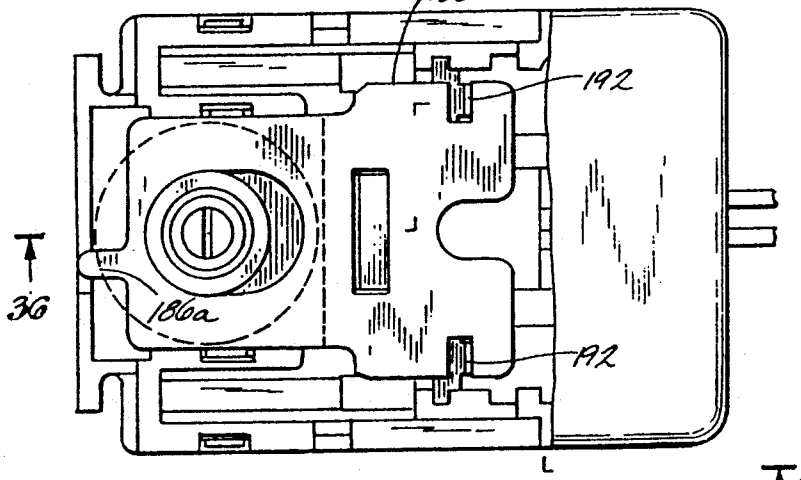
FIG. 35 is a top view of the accessory device of FIG. 30 with the cover removed.
Figure 36:
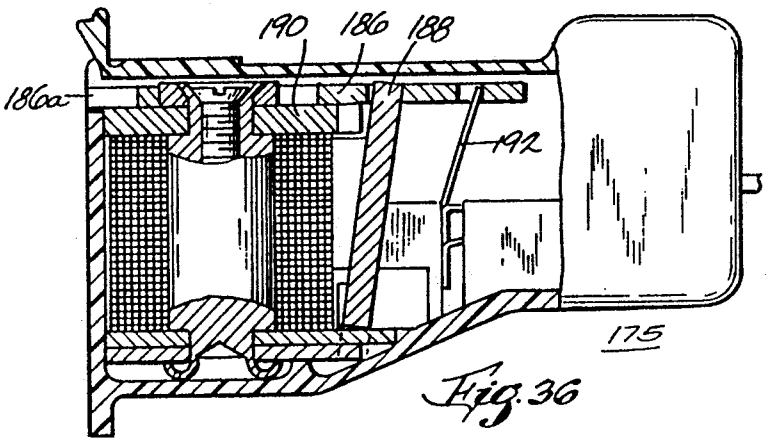
FIG. 36 is a cross sectional view of the accessory device shown in FIG. 34 taken along the line 36—36 in FIG. 35.

As mentioned hereinbefore, accessory device 174 may be an auxiliary switch, a shunt trip or an under-voltage release. Each of these devices utilize components actuated by levers 174c. Moreover, each of the auxiliary devices are packaged within the same molded housing and use many parts common to both devices. Referring to FIGS. 35–38, for example, the shunt trip accessory device 175 (FIGS. 35–36) and the under-voltage release accessory device 177 (FIGS. 37–38) comprise a slide bar 186 which has a projection 186a that abuts boss 116b of lever 116 and extends into opening 112c in trip unit base 112 to pivot lever 116 which then rotates trip bar 132 to trip the breaker. Both the shunt trip unit and the under-voltage release unit operate with clapper type armatures attracted to a pole piece disposed at one end of a coil as shown in FIGS. 36 and 38. The shunt trip device 175 has the armature 188 biased away from the pole piece 190 by a pair of leaf springs 192 fixed in the housing and having their free ends disposed in slots 186b in slider 186, biasing slider 186 to the right away from pole piece 190. The upper end of armature 188 projects within a slot 186c in slider 186 for driving connection therewith, and therefore armature 188 is biased away from pole piece 190 by springs 192. Energization of the coil establishes a magnetic field in the pole piece 190 to attract the armature 188 thereto, moving to the left as viewed in FIG. 36, to extend the slider 186 and projection 186a for operatively pivoting lever 116.

An under-voltage release accessory device is customarily an energized electromagnetic coil that holds the armature in a predisposed position until de-energized in a low voltage condition. The device then operates to trip the circuit breaker. In order to make under-voltage release device 177 (FIGS. 37 and 38) also operate the slider 186 to the left, a special pole piece 194 is provided that has a rectangular hole 194a through which the upper end of the armature 188 projects. A coil spring 196 is connected in tension to the armature 188 and to a coil support plate to normally bias the armature 188 into engagement with a left side of the opening 194a adjacent the coil. The under-voltage release device is reset when the breaker contacts open, moving the shaft 66 and strap 68 against the spring 174d at the lower end of actuator lever 174c. The upper end of lever 174c within the accessory housing moves rightward, physically moving the armature 188 against the right-hand edge of the opening 194a in the pole piece 194. The energized coil sets up a latching magnetic field in the pole piece 194 to hold the armature against the right-hand edge of the opening 194a until the coil is de-energized and the magnetic field is reduced, permitting the spring 196 to drive armature 188 and slider 186 to the left to trip the breaker.

Another type of accessory device used with circuit breakers of the type herein described is an alarm switch. With reference to FIGS. 30–33, the circuit breaker of this invention provides for an alarm switch 198 to be mounted directly over latch 170 and operated directly by the latch. Alarm switch 198 comprises a molded insulating case 200 having a pair of lateral wings 200a and a resilient catch 200b at the center of the upper edge thereof. Case 200 is a hollow member, open to a back side thereof, and receives a snap action switch 202 within the hollow cavity of the case. Although not particularly shown, a flat cover member is slidably mounted to the open side of the case and retained there by a resilient catch similar to catch 200b. The cover secures the switch 202 within the case. A spring 204 is also secured within the case. One end of spring 204 overlies the plunger of the snap action switch while the other end of the spring extends externally of the case. The U-shaped bracket 154 for the latching mechanism which is attached to the trip unit housing has a pair of notches 154d in the upper edges thereof which receive wings 200a on the case 200 of the alarm switch 198. The molded catch member 200b snaps into the shallow recess 112n of the center pole of the trip unit to firmly latch the alarm switch 198 in place Leaf spring 204 is positioned between the latch 170 and the housing 112 of the trip unit and is actuated by the latch 170 when the same is released by the trip lever 160. Movement of the leaf spring actuator 204 of the alarm switch 198 depresses the plunger of the miniature snap action switch 202.

As is evident from the foregoing description and drawings, the present invention provides substantial improvements in the operation and assembly of molded case circuit breakers. It will also be apparent that various details of the illustrated forms of the present invention, shown in their preferred embodiments, may be modified without departing from the inventive concept and the scope of the appended claims.

I claim:

1. A circuit breaker comprising, in combination:

an insulating housing comprising a molded insulating base and molded insulating cover means defining a plurality of co-extensive compartments within said housing;

a pair of terminals extending from each said compartment to opposite exterior ends of said housing;

a stationary contact connected to one of said terminals within each said compartment;

a movable contact finger having a contact thereon within each said compartment movable into and out of engagement with respective said stationary contacts;

a movable frame supported for pivotal movement in each said compartment, said frame comprising means providing a resilient driving connection with a respective said movable contact finger;

an operating mechanism in one of said compartments for moving said movable frame in said one of said compartments, said operating mechanism comprising an operating handle, a collapsible toggle linkage connected to a respective said movable frame in said one of said compartments, and a latching mechansim;

current responsive tripping means for releasing said latching mechanism, thereby effecting collapse of said toggle linkage and movement of said movable frame and said movable contact finger contact in said one of said compartments out of engagement with a respective said stationary contact;

a shaft extending between said compartments attached to each said movable frame for effecting unitary movement of all said movable frames, said shaft having a beveled side surface; and clamping means for attaching said shaft to respective said movable frames, said clamping means comprising a strap encompassing said shaft, said strap having opposite ends secured to said movable frame, said strap further having means cooperating with said beveled side surface for camming said shaft against a juncture of one end of said strap and said respective movable frame.

2. The circuit breaker defined in claim 1 wherein said strap comprises a substantially rigid preformed U-shaped member having a pair of legs joined by a substantially straight cross member, said opposite ends being free ends of said legs of said U-shaped member, one of said legs comprising an oblique portion relative to said other of said legs and to said cross member, said oblique portion being intermediate said respective free end and said cross member and substantially parallel to said beveled side surface for cooperating therewith for camming said shaft against said juncture of said one end of said strap and said respective movable frame.

3. The circuit breaker defined in claim 1 wherein said shaft comprises first and second elongated adjacent surfaces disposed at a right angle, and said beveled surface disposed opposite said right angle and oblique to said first and to said second surfaces.

4. The circuit breaker defined in claim 2 wherein said other of said legs is disposed at a right angle to said cross member.

5. The circuit breaker defined in claim 4 wherein said free ends of said legs are substantially parallel to each other.

6. The circuit breaker defined in claim 5 wherein said free ends of said legs form substantially right angles with said movable frame.

* * * * *